US008425004B2

(12) United States Patent
McAvoy et al.

(10) Patent No.: US 8,425,004 B2
(45) **Date of Patent: *Apr. 23, 2013**

(54) PRINTHEAD HAVING POLYMER INCORPORATING NANOPARTICLES COATED ON INK EJECTION FACE

(75) Inventors: Gregory John McAvoy, Dublin (IE); Rónán Pádraig Seán O'Reilly, Dublin (IE); Emma Rose Kerr, Dublin (IE)

(73) Assignee: Zamtec Ltd, Dublin (IE)

( * ) Notice: Subject to any disclaimer, the term of this patent is extended or adjusted under 35 U.S.C. 154(b) by 608 days.

This patent is subject to a terminal disclaimer.

(21) Appl. No.: 12/508,566

(22) Filed: Jul. 24, 2009

(65) Prior Publication Data

US 2011/0018936 A1 Jan. 27, 2011

(51) Int. Cl.
*B41J 2/135* (2006.01)

(52) U.S. Cl.
USPC ..... 347/44; 347/45

(58) Field of Classification Search ..... 347/29, 347/40, 45–47, 49, 64, 65, 67, 71
See application file for complete search history.

(56) References Cited

U.S. PATENT DOCUMENTS

| | | | | |
|---|---|---|---|---|
| 6,151,045 | A * | 11/2000 | Beach et al. | 347/45 |
| 6,302,523 | B1 * | 10/2001 | Smith et al. | 347/45 |
| 6,341,842 | B1 | 1/2002 | Beach et al. | |
| 7,232,206 | B2 * | 6/2007 | Sasaki et al. | 347/45 |
| 8,029,111 | B2 * | 10/2011 | Matsuo et al. | 347/71 |
| 2008/0227229 | A1 | 9/2008 | McAvoy et al. | |

FOREIGN PATENT DOCUMENTS

JP 01-217352 A 8/1989

OTHER PUBLICATIONS

You B et al, "Chemical and anticorrosion characterization of polysilsesquioxan coatings catalyzed by different acids"; The free library, by Farlex, Mar. 1, 2008, p. 1-10. See introduction.

* cited by examiner

*Primary Examiner* — Thinh Nguyen
(74) *Attorney, Agent, or Firm* — Cooley LLP

(57) ABSTRACT

A printhead having an ink ejection face, wherein at least part of the ink ejection face is coated with a polymeric material. The polymeric material is comprised of a polymerized siloxane incorporating nanoparticles. The printhead may be compatible with various printhead maintenance operations, ink characteristics and inkjet nozzle types.

14 Claims, 23 Drawing Sheets

PRINTHEAD HAVING POLYMER INCORPORATING NANOPARTICLES COATED ON INK EJECTION FACE

FIELD OF THE INVENTION

The present invention relates to the field of printers and particularly inkjet printheads. It has been developed primarily to improve print quality and printhead maintenance in high resolution printheads.

CROSS REFERENCES

Various methods, systems and apparatus relating to the present invention are disclosed in the following US Patents/Patent Applications filed by the applicant or assignee of the present invention:

| | | | | |
|---|---|---|---|---|
| 7,344,226 | 7,328,976 | 11/685,084 | 11/685,086 | 11/685,090 |
| 11/740,925 | 11/763,444 | 11/763,443 | 11/946,840 | 11/961,712 |
| 12/017,771 | 7,367,648 | 7,370,936 | 7,401,886 | 11/246,708 |
| 7,401,887 | 7,384,119 | 7,401,888 | 7,387,358 | 7,413,281 |
| 11/482,958 | 11/482,955 | 11/482,962 | 11/482,963 | 11/482,956 |
| 11/482,954 | 11/482,974 | 11/482,957 | 11/482,987 | 11/482,959 |
| 11/482,960 | 11/482,961 | 11/482,964 | 11/482,965 | 11/482,976 |
| 11/482,973 | 11/495,815 | 11/495,816 | 11/495,817 | 60/992,635 |
| 60/992,637 | 60/992,641 | 12/050,078 | 12/050,066 | 12/138,376 |
| 12/138,373 | 12/142,774 | 12/140,192 | 12/140,264 | 12/140,270 |
| 11/607,976 | 11/607,975 | 11/607,999 | 11/607,980 | 11/607,979 |
| 11/607,978 | 11/735,961 | 11/685,074 | 11/696,126 | 11/696,144 |
| 7,384,131 | 11/763,446 | 6,665,094 | 7,416,280 | 7,175,774 |
| 7,404,625 | 7,350,903 | 11/293,832 | 12/142,779 | 11/124,158 |
| 6,238,115 | 6,390,605 | 6,322,195 | 6,612,110 | 6,480,089 |
| 6,460,778 | 6,305,788 | 6,426,014 | 6,364,453 | 6,457,795 |
| 6,315,399 | 6,755,509 | 11/763,440 | 11/763,442 | 12/114,826 |
| 12/114,827 | 12/239,814 | 12/239,815 | 12/239,816 | 11/246,687 |
| 7,156,508 | 7,303,930 | 7,246,886 | 7,128,400 | 7,108,355 |
| 6,987,573 | 10/727,181 | 6,795,215 | 7,407,247 | 7,374,266 |
| 6,924,907 | 11/544,764 | 11/293,804 | 11/293,794 | 11/293,828 |
| 11/872,714 | 10/760,254 | 7,261,400 | 11/583,874 | 11/782,590 |
| 11/014,764 | 11/014,769 | 11/293,820 | 11/688,863 | 12/014,767 |
| 12/014,768 | 12/014,769 | 12/014,770 | 12/014,771 | 12/014,772 |
| 11/482,982 | 11/482,983 | 11/482,984 | 11/495,818 | 11/495,819 |
| 12/062,514 | 12/192,116 | 7,306,320 | 10/760,180 | 6,364,451 |
| 7,093,494 | 6,454,482 | 7,377,635 | 12/323,471 | 12/014,772 |
| 7,401,886 | 7,530,663 | 11/495,815 | | |

BACKGROUND OF THE INVENTION

Many different types of printing have been invented, a large number of which are presently in use. The known forms of print have a variety of methods for marking the print media with a relevant marking media. Commonly used forms of printing include offset printing, laser printing and copying devices, dot matrix type impact printers, thermal paper printers, film recorders, thermal wax printers, dye sublimation printers and ink jet printers both of the drop on demand and continuous flow type. Each type of printer has its own advantages and problems when considering cost, speed, quality, reliability, simplicity of construction and operation etc.

In recent years, the field of ink jet printing, wherein each individual pixel of ink is derived from one or more ink nozzles has become increasingly popular primarily due to its inexpensive and versatile nature.

Many different techniques on ink jet printing have been invented. For a survey of the field, reference is made to an article by J Moore, "Non-Impact Printing: Introduction and Historical Perspective", Output Hard Copy Devices, Editors R Dubeck and S Sherr, pages 207-220 (1988).

Ink Jet printers themselves come in many different types. The utilization of a continuous stream of ink in ink jet printing appears to date back to at least 1929 wherein U.S. Pat. No. 1,941,001 by Hansell discloses a simple form of continuous stream electro-static ink jet printing.

U.S. Pat. No. 3,596,275 by Sweet also discloses a process of a continuous ink jet printing including the step wherein the ink jet stream is modulated by a high frequency electro-static field so as to cause drop separation. This technique is still utilized by several manufacturers including Elmjet and Scitex (see also U.S. Pat. No. 3,373,437 by Sweet et al)

Piezoelectric ink jet printers are also one form of commonly utilized ink jet printing device. Piezoelectric systems are disclosed by Kyser et. al. in U.S. Pat. No. 3,946,398 (1970) which utilizes a diaphragm mode of operation, by Zolten in U.S. Pat. No. 3,683,212 (1970) which discloses a squeeze mode of operation of a piezoelectric crystal, Stemme in U.S. Pat. No. 3,747,120 (1972) discloses a bend mode of piezoelectric operation, Howkins in U.S. Pat. No. 4,459,601 discloses a piezoelectric push mode actuation of the ink jet stream and Fischbeck in U.S. Pat. No. 4,584,590 which discloses a shear mode type of piezoelectric transducer element.

Recently, thermal ink jet printing has become an extremely popular form of ink jet printing. The ink jet printing techniques include those disclosed by Endo et al in GB 2007162 (1979) and Vaught et al in U.S. Pat. No. 4,490,728. Both the aforementioned references disclosed ink jet printing techniques that rely upon the activation of an electrothermal actuator which results in the creation of a bubble in a constricted space, such as a nozzle, which thereby causes the ejection of ink from an aperture connected to the confined space onto a relevant print media. Printing devices utilizing the electro-thermal actuator are manufactured by manufacturers such as Canon and Hewlett Packard.

As can be seen from the foregoing, many different types of printing technologies are available. Ideally, a printing technology should have a number of desirable attributes. These include inexpensive construction and operation, high speed operation, safe and continuous long term operation etc. Each technology may have its own advantages and disadvantages in the areas of cost, speed, quality, reliability, power usage, simplicity of construction operation, durability and consumables.

In the construction of any inkjet printing system, there are a considerable number of important factors which must be traded off against one another especially as large scale printheads are constructed, especially those of a pagewidth type. A number of these factors are outlined below.

Firstly, inkjet printheads are normally constructed utilizing micro-electromechanical systems (MEMS) techniques. As such, they tend to rely upon standard integrated circuit construction/fabrication techniques of depositing planar layers on a silicon wafer and etching certain portions of the planar layers. Within silicon circuit fabrication technology, certain techniques are better known than others. For example, the techniques associated with the creation of CMOS circuits are likely to be more readily used than those associated with the creation of exotic circuits including ferroelectrics, gallium arsenide etc. Hence, it is desirable, in any MEMS constructions, to utilize well proven semi-conductor fabrication techniques which do not require any "exotic" processes or materials. Of course, a certain degree of trade off will be undertaken in that if the advantages of using the exotic material far out weighs its disadvantages then it may become desirable to utilize the material anyway. However, if it is possible to achieve the same, or similar, properties using more common materials, the problems of exotic materials can be avoided.

A desirable characteristic of inkjet printheads would be a hydrophobic ink ejection face ("front face" or "nozzle face"), preferably in combination with hydrophilic nozzle chambers and ink supply channels. Hydrophilic nozzle chambers and ink supply channels provide a capillary action and are therefore optimal for priming and for re-supply of ink to nozzle chambers after each drop ejection. A hydrophobic front face minimizes the propensity for ink to flood across the front face of the printhead. With a hydrophobic front face, the aqueous inkjet ink is less likely to flood sideways out of the nozzle openings. Furthermore, any ink which does flood from nozzle openings is less likely to spread across the face and mix on the front face—they will instead form discrete spherical micro-droplets which can be managed more easily by suitable maintenance operations.

Hitherto, the present Applicant has described the use of PDMS (polydimethylsiloxane) for coating the front face of a printhead and providing a hydrophobic surface. However, whilst PDMS has excellent hydrophobic properties and can be readily incorporated into a printhead MEMS fabrication process, it has relatively poor wear-resistance and may be scratched or otherwise damaged by a wiper blade used for printhead maintenance (see, for example, U.S. application Ser. No. 12/014,772, filed on Jan. 16, 2008 incorporated herein by reference). It would therefore be desirable to provide a printhead having a hydrophobic ink ejection face, which can be readily produced by a MEMS fabrication process and which has good wear-resistance.

SUMMARY OF THE INVENTION

In a first aspect, there is provided a printhead having an ink ejection face, wherein at least part of the ink ejection face is coated with a hydrophobic polymeric material, the polymeric material being comprised of a polysilsesquioxane. Printheads according to the present invention have excellent durability and wear-resistance making them compatible with various printhead maintenance operation involving contact with the ink ejection face (e.g. wiping). Moreover, the polysilsesquioxane can be deposited in a thin layer (0.5 to 2 microns) by a spin-on process, which is readily incorporated into a MEMS printhead fabrication process.

Optionally, the polysilsesquioxane is selected from the group consisting of: poly(alkylsilsesquioxanes) and poly(arylsilsesquioxanes)

Optionally, the polysilsesquioxane is selected from the group consisting of: poly(methylsilsesquioxane) and poly (phenylsilsesquioxane).

Optionally, the polymeric material is deposited and hard-baked onto a nozzle plate of the printhead during MEMS printhead fabrication.

Optionally, the printhead comprises a plurality of nozzle assemblies formed on a substrate, each nozzle assembly comprising: a nozzle chamber, a nozzle opening defined in a roof of the nozzle chamber and an actuator for ejecting ink through the nozzle opening.

Optionally, the polymeric material is coated on a nozzle plate of the printhead, the nozzle plate being at least partially defined by the roof of each nozzle chamber.

Optionally, each roof has a hydrophobic outside surface relative to the inside surfaces of each nozzle chamber by virtue of the hydrophobic coating.

Optionally, each nozzle chamber comprises a roof and sidewalls comprised of a ceramic material.

Optionally, the ceramic material is selected from the group consisting of: silicon nitride, silicon oxide and silicon oxynitride.

Optionally, the roof is spaced apart from the substrate, such that sidewalls of each nozzle chamber extend between the nozzle plate and the substrate.

Optionally, the actuator is a heater element configured for heating ink in the chamber so as to form a gas bubble, thereby forcing a droplet of ink through the nozzle opening.

Optionally, the heater element is suspended in the nozzle chamber.

Optionally, the actuator is a thermal bend actuator comprising:

a first active element for connection to drive circuitry; and a second passive element mechanically cooperating with the first element, such that when a current is passed through the first element, the first element expands relative to the second element, resulting in bending of the actuator.

Optionally, the thermal bend actuator defines at least part of a roof of each nozzle chamber, whereby actuation of the actuator moves said a moving portion of the roof towards a floor of said nozzle chamber.

Optionally, the nozzle opening is defined in said moving portion of the roof.

Optionally, nozzle opening is defined in a stationary portion of the roof.

Optionally, the polymeric material defines a mechanical seal between the moving portion and a stationary portion of the roof, thereby minimizing ink leakage during actuation of the actuator.

In a second aspect, there is provided a printhead having an ink ejection face, wherein at least part of the ink ejection face is coated with a polymeric material, said polymeric material being comprised of a polymerized siloxane incorporating nanoparticles. In accordance with the second aspect, the nanoparticles impart desirable properties to the polymeric coating, such as durability, wear-resistance, fatigue-resistance, hydrophobicity, hydrophilicity etc.

Optionally, the polymerized siloxane is selected from the group consisting of: poly(alkylsilsesquioxanes), poly(arylsilsesquioxanes) and polydialkylsiloxanes Optionally, the polymerized siloxane is selected from the group consisting of: poly(methylsilsesquioxane), poly(phenylsilsesquioxane) and polydimethylsiloxane.

Optionally, the nanoparticles are selected from the group consisting of: inorganic nanoparticles and organic nanoparticles.

Optionally, the inorganic nanoparticles are selected from the group consisting of: metal oxides, metal carbonates and metal sulfates.

Optionally, the inorganic nanoparticles are selected from the group consisting of: silica, zirconium oxide, titanium oxide, aluminium oxide, calcium carbonate, tin oxide, zinc oxide, copper oxide, chromium oxide, calcium oxide, tungsten oxide, iron oxide, cobalt oxide and barium sulfate.

Optionally, the organic nanoparticles are selected from the group consisting of: cross-linked silicone resin particles, cross-linked polyolefin resin particles, cross-linked acryl resin particles, cross-linked styrene-acryl resin particles, cross-linked polyester particles, polyimide particles, melamine resin particles and carbon nanotubes.

Optionally, the nanoparticles are incorporated in the polymerized siloxane in an amount ranging from 1 to 70 wt. %.

Optionally, the nanoparticles have an average particle size in the range of 1 to 100 nm.

Optionally, the printhead comprises a plurality of nozzle assemblies formed on a substrate, each nozzle assembly comprising: a nozzle chamber, a nozzle opening defined in a roof of the nozzle chamber and an actuator for ejecting ink through the nozzle opening.

Optionally, the polymeric material is coated on a nozzle plate of the printhead, the nozzle plate being at least partially defined by the roof of each nozzle chamber.

Optionally, each nozzle chamber comprises a roof and sidewalls comprised of a ceramic material selected from the group consisting of: silicon nitride, silicon oxide and silicon oxynitride.

Optionally, the roof is spaced apart from the substrate, such that sidewalls of each nozzle chamber extend between the nozzle plate and the substrate.

Optionally, the actuator is a heater element configured for heating ink in the chamber so as to form a gas bubble, thereby forcing a droplet of ink through the nozzle opening.

Optionally, the heater element is suspended in the nozzle chamber.

Optionally, the actuator is a thermal bend actuator comprising:

a first active element for connection to drive circuitry; and a second passive element mechanically cooperating with the first element, such that when a current is passed through the first element, the first element expands relative to the second element, resulting in bending of the actuator.

Optionally, the thermal bend actuator defines at least part of a roof of each nozzle chamber, whereby actuation of said actuator moves said a moving portion of said roof towards a floor of said nozzle chamber.

Optionally, the nozzle opening is defined in either one of: said moving portion of said roof; or a stationary portion of said roof.

Optionally, the polymeric material defines a mechanical seal between said moving portion and a stationary portion of said roof, thereby minimizing ink leakage during actuation of said actuator.

In a third aspect, there is provided an inkjet printhead for ejection of an ejectable fluid, the printhead having an ink ejection face coated with a polymeric material incorporating nanoparticles, wherein the nanoparticles impart one or more predetermined characteristics to the ink ejection face, the predetermined characteristics complementing at least one of:

an inherent property of the ejectable fluid;

a printhead maintenance regime associated with the printhead; and a type of nozzle actuator.

The invention according to the third aspect, enables the surface characteristics of the ink ejection face to be tuned to a predetermined characteristic of the printer. For example, printhead maintenance may be prioritized in some printers, whereas optimal fluid ejection may be prioritized in other printers. Alternatively, the nanoparticles may be selected to provide a compromise of printer characteristics.

Optionally, the one or more predetermined characteristics are selected from the group consisting of: hydrophilicity; hydrophobicity; wear-resistance; and fatigue-resistance.

Optionally, the one or more predetermined characteristics are imparted by one or more of: surface energy characteristics of the nanoparticles; size of the nanoparticles; amount of the nanoparticles; and wearability of the nanoparticles.

Optionally, the nanoparticles are selected from the group consisting of: inorganic nanoparticles and organic nanoparticles.

Optionally, the inorganic nanoparticles are selected from the group consisting of: silica, zirconium oxide, titanium oxide, aluminium oxide, calcium carbonate, tin oxide, zinc oxide, copper oxide, chromium oxide, calcium oxide, tungsten oxide, iron oxide, cobalt oxide and barium sulfate.

Optionally, the organic nanoparticles are selected from the group consisting of: cross-linked silicone resin particles, cross-linked polyolefin resin particles, cross-linked acryl resin particles, cross-linked styrene-acryl resin particles, cross-linked polyester particles, polyimide particles, melamine resin particles and carbon nanotubes.

Optionally, the the inherent property of the ejectable fluid is selected from the group consisting of: hydrophilicity; hydrophobicity; viscosity; surface tension; and boiling point.

Optionally, the ejectable fluid is selected from the group consisting of: aqueous fluids and non-aqueous fluids.

Optionally, the printhead maintenance regime comprises one or more operations selected from the group consisting of: printhead capping; printhead wiping; printhead flooding; and non-contact ink removal.

Optionally, the the polymeric material is a comprised of a polymerized siloxane.

Optionally, the polymerized siloxane is selected from the group consisting of: poly(alkylsilsesquioxanes), poly(arylsilsesquioxanes) and polydialkylsiloxanes Optionally, the polymerized siloxane is selected from the group consisting of: poly(methylsilsesquioxane), poly(phenylsilsesquioxane) and polydimethylsiloxane.

Other optional embodiments of the printhead according to the third aspect mirror those optional embodiments according to the first and second aspects.

BRIEF DESCRIPTION OF THE DRAWINGS

Optional embodiments of the present invention will now be described by way of example only with reference to the accompanying drawings, in which.

DESCRIPTION OF OPTIONAL EMBODIMENTS

The present invention may be used with any type of printhead. The present Applicant has previously described a plethora of inkjet printheads. It is not necessary to describe all such printheads here for an understanding of the present invention. However, the present invention will now be described in connection with a thermal bubble-forming inkjet printhead and a mechanical thermal bend actuated inkjet printhead. Advantages of the present invention will be readily apparent from the discussion that follows.

Thermal Bubble-Forming Inkjet Printhead

Figure 1:
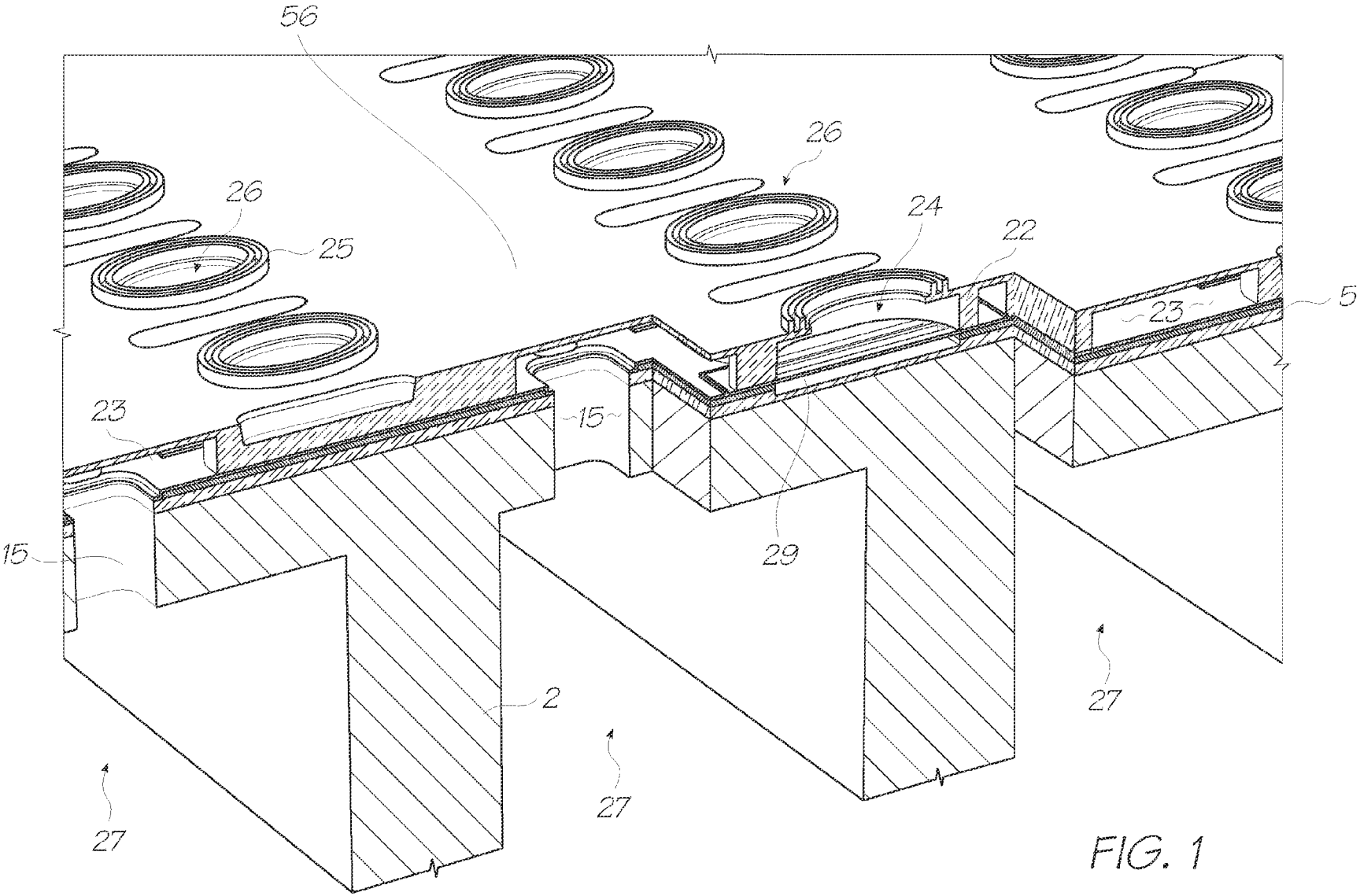
FIG. 1 is a partial perspective view of an array of nozzle assemblies of a thermal inkjet printhead.
Figure 2:
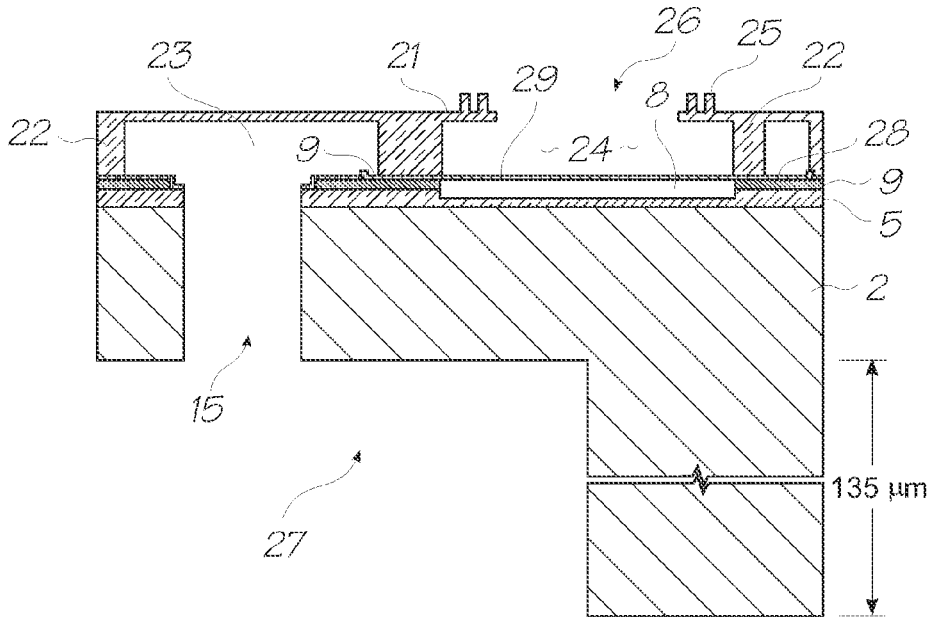
FIG. 2 is a side view of a nozzle assembly unit cell shown in FIG. 1.
Figure 3:
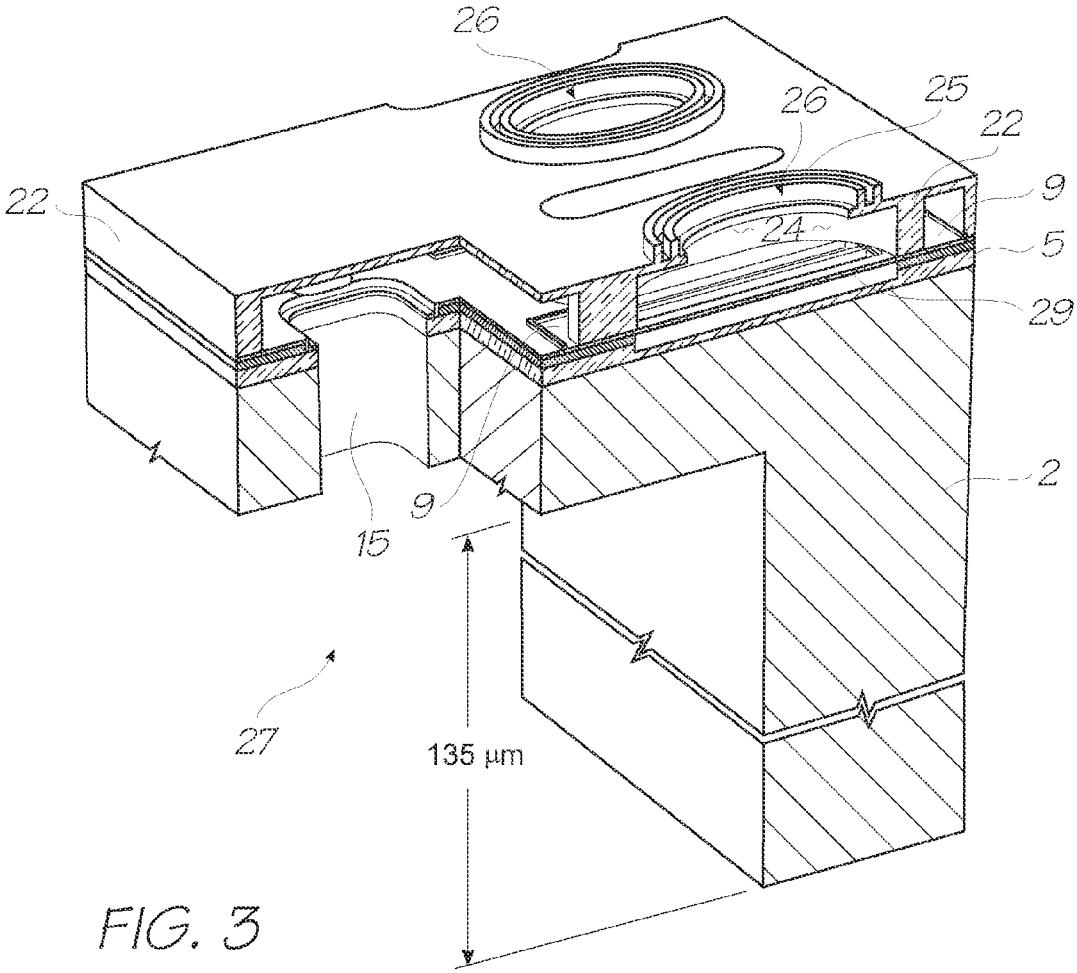
FIG. 3 is a perspective of the nozzle assembly shown in FIG. 2.

Referring to FIG. 1, there is shown a part of printhead comprising a plurality of nozzle assemblies. FIGS. 2 and 3 show one of these nozzle assemblies in side-section and cutaway perspective views.

Each nozzle assembly comprises a nozzle chamber 24 formed by MEMS fabrication techniques on a silicon wafer substrate 2. The nozzle chamber 24 is defined by a roof 21 and sidewalls 22 which extend from the roof 21 to the silicon substrate 2. As shown in FIG. 1, each roof is defined by part of a nozzle surface 56, which spans across an ejection face of the printhead. The nozzle surface 56 and sidewalls 22 are formed of the same material, which is deposited by PECVD over a sacrificial scaffold of photoresist during MEMS fabrication. Typically, the nozzle surface 56 and sidewalls 22 are formed of a ceramic material, such as silicon dioxide or silicon nitride. These hard materials have excellent properties for printhead robustness, and their inherently hydrophilic nature is advantageous for supplying ink to the nozzle chambers 24 by capillary action. However, the exterior (ink ejection) surface of the nozzle surface 56 is also hydrophilic, which causes any flooded ink on the surface to spread.

Returning to the details of the nozzle chamber 24, it will be seen that a nozzle opening 26 is defined in a roof of each nozzle chamber 24. Each nozzle opening 26 is generally elliptical and has an associated nozzle rim 25. The nozzle rim 25 assists with drop directionality during printing as well as reducing, at least to some extent, ink flooding from the nozzle opening 26. The actuator for ejecting ink from the nozzle chamber 24 is a heater element 29 positioned beneath the nozzle opening 26 and suspended across a pit 8. Current is supplied to the heater element 29 via electrodes 9 connected to drive circuitry in underlying CMOS layers 5 of the substrate 2. When a current is passed through the heater element 29, it rapidly superheats surrounding ink to form a gas bubble, which forces ink through the nozzle opening. By suspending the heater element 29, it is completely immersed in ink when the nozzle chamber 24 is primed. This improves printhead efficiency, because less heat dissipates into the underlying substrate 2 and more input energy is used to generate a bubble.

As seen most clearly in FIG. 1, the nozzles are arranged in rows and an ink supply channel 27 extending longitudinally along the row supplies ink to each nozzle in the row. The ink supply channel 27 delivers ink to an ink inlet passage 15 for each nozzle, which supplies ink from the side of the nozzle opening 26 via an ink conduit 23 in the nozzle chamber 24.

The MEMS fabrication process for manufacturing such printheads was described in detail in our previously filed U.S. application Ser. No. 11/246,684 filed on Oct. 11, 2005, the contents of which is herein incorporated by reference. The latter stages of this fabrication process are briefly revisited here for the sake of clarity.

Figure 4:
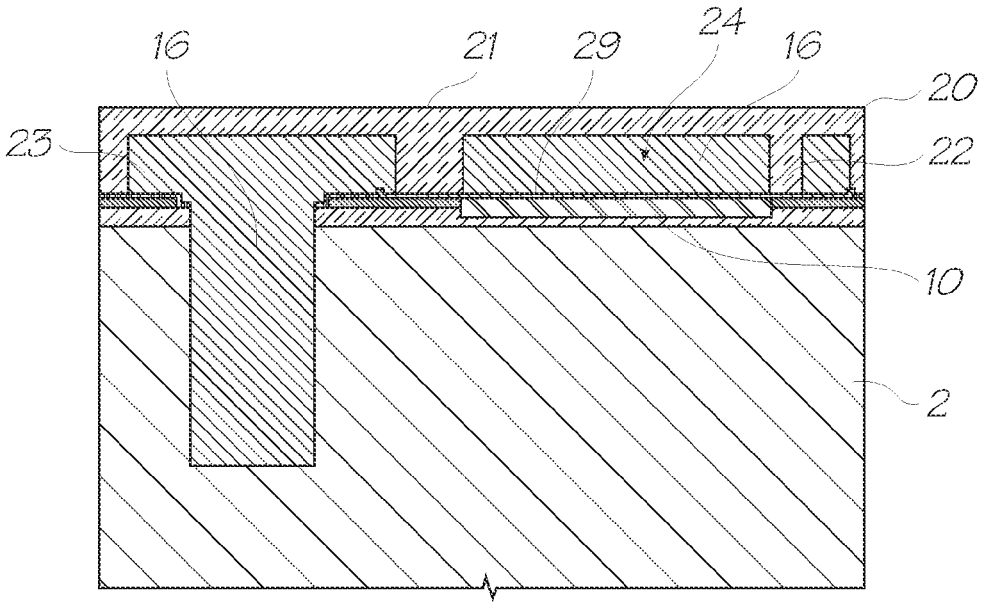
FIG. 4 shows a partially-formed nozzle assembly after deposition of side walls and roof material onto a sacrificial photoresist layer.
Figure 5:
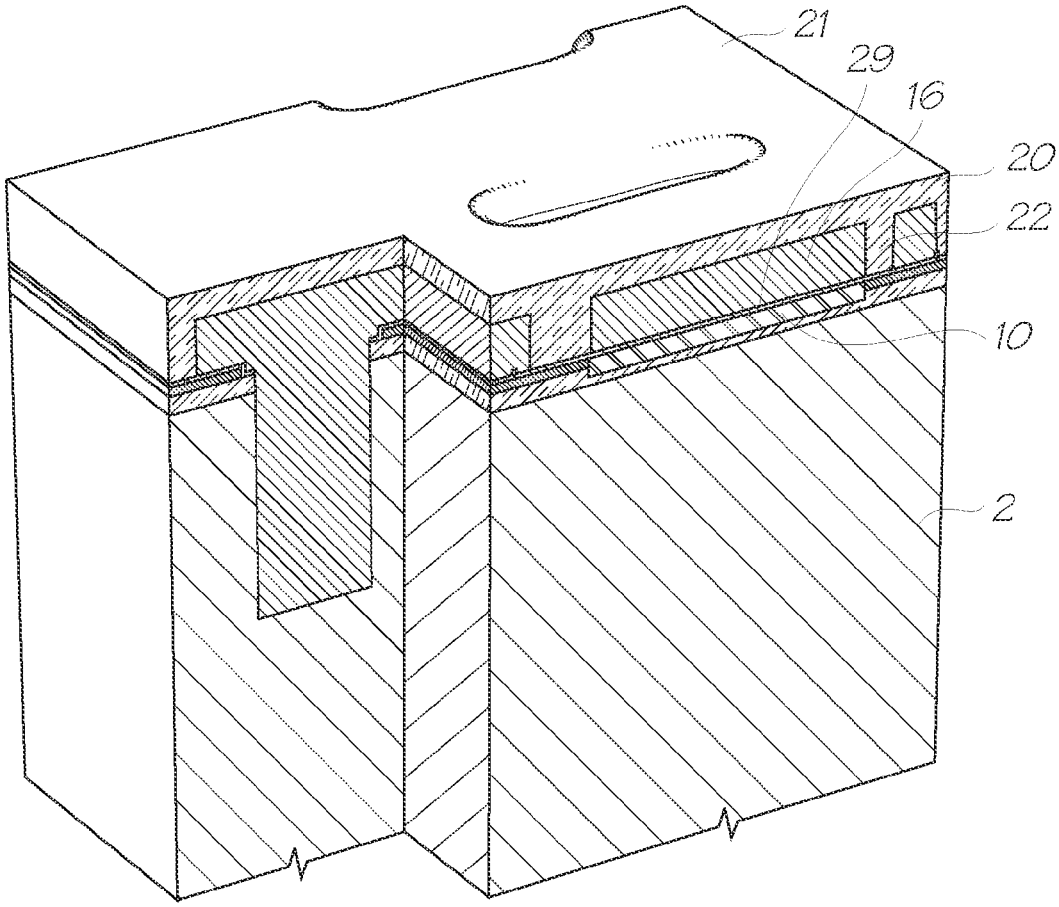
FIG. 5 is a perspective of the nozzle assembly shown in FIG. 4.

FIGS. 4 and 5 show a partially-fabricated printhead comprising a nozzle chamber 24 encapsulating sacrificial photoresist 10 ("SAC1") and 16 ("SAC2"). The SAC1 photoresist 10 was used as a scaffold for deposition of heater material to form the suspended heater element 29. The SAC2 photoresist 16 was used as a scaffold for deposition of the sidewalls 22 and roof 21 (which defines part of the nozzle surface 56).

Figure 6:
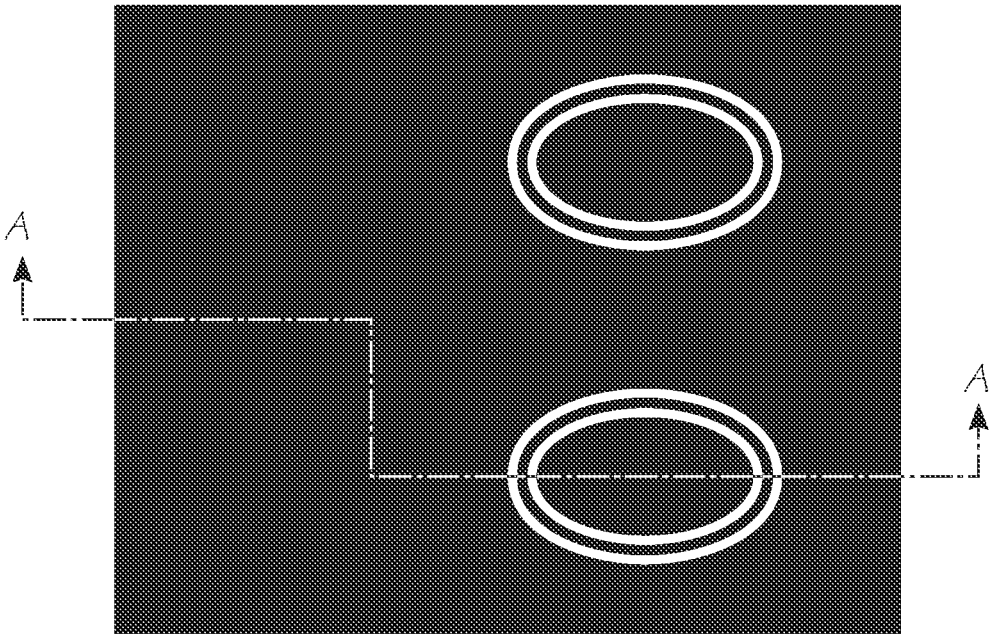
FIG. 6 is the mask associated with the nozzle rim etch shown in FIG. 7.
Figure 7:
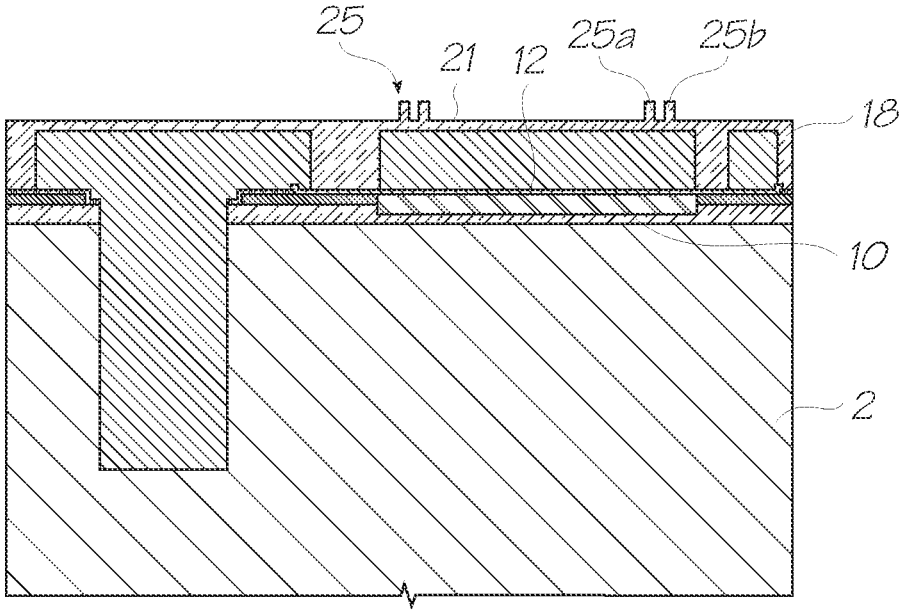
FIG. 7 shows the etch of the roof layer to form the nozzle opening rim.
Figure 8:
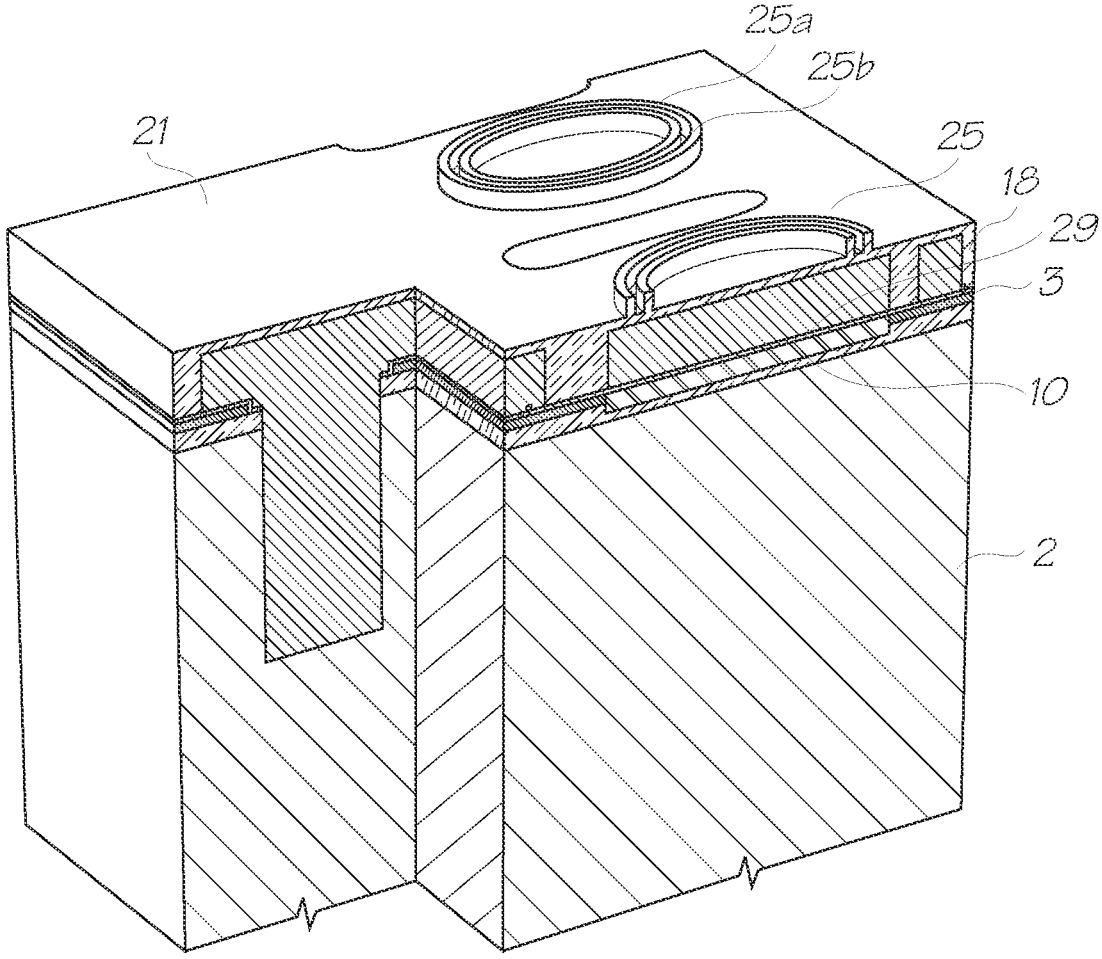
FIG. 8 is a perspective of the nozzle assembly shown in FIG. 7.

In the prior art process, and referring to FIGS. 6 to 8, the next stage of MEMS fabrication defines the elliptical nozzle rim 25 in the roof 21 by etching away 2 microns of roof material 20. This etch is defined using a layer of photoresist (not shown) exposed by the dark tone rim mask shown in FIG. 6. The elliptical rim 25 comprises two coaxial rim lips 25*a* and 25*b*, positioned over their respective thermal actuator 29.

Figure 9:
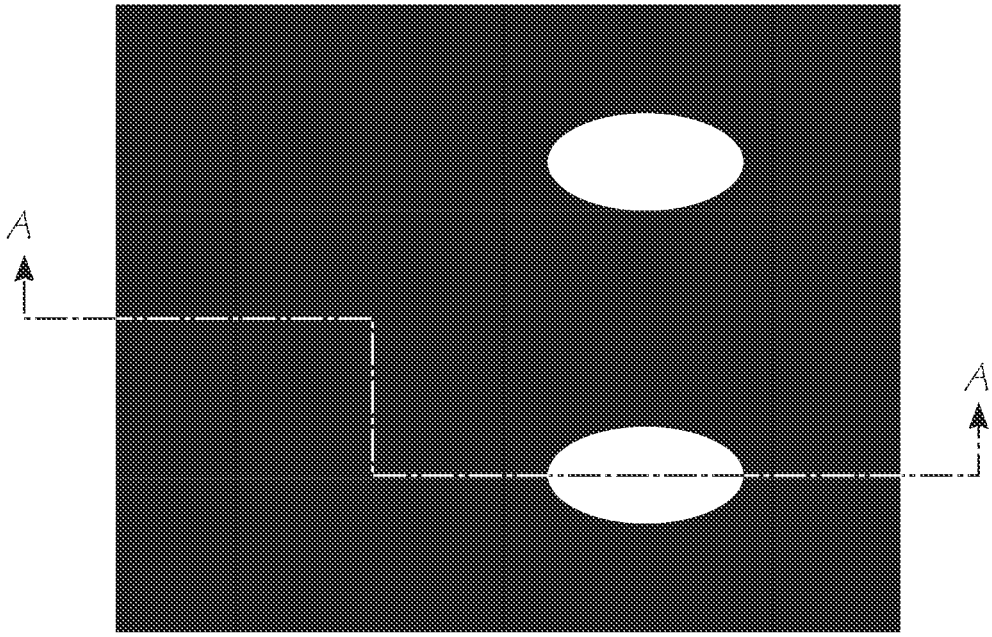
FIG. 9 is the mask associated with the nozzle opening etch shown in FIG. 10.
Figure 10:
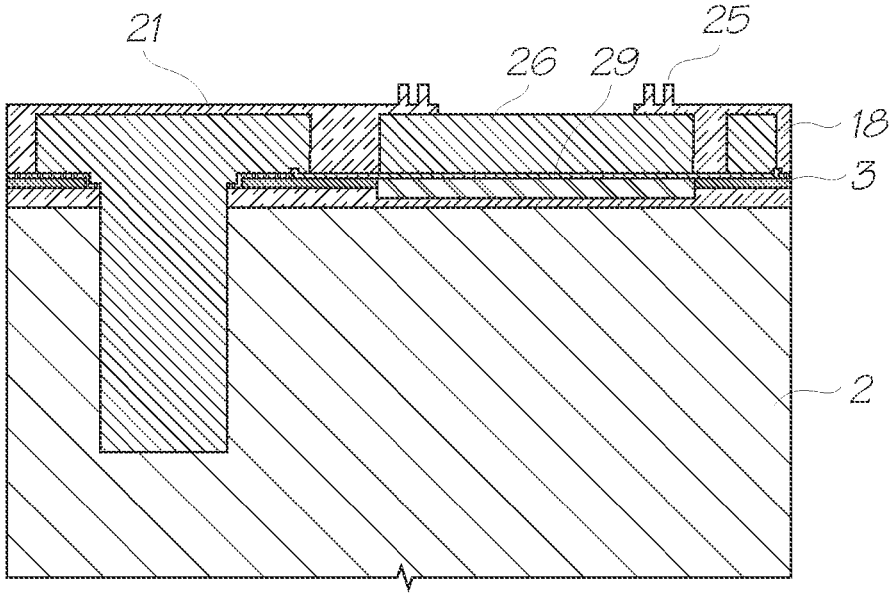
FIG. 10 shows the etch of the roof material to form the elliptical nozzle openings.
Figure 11:
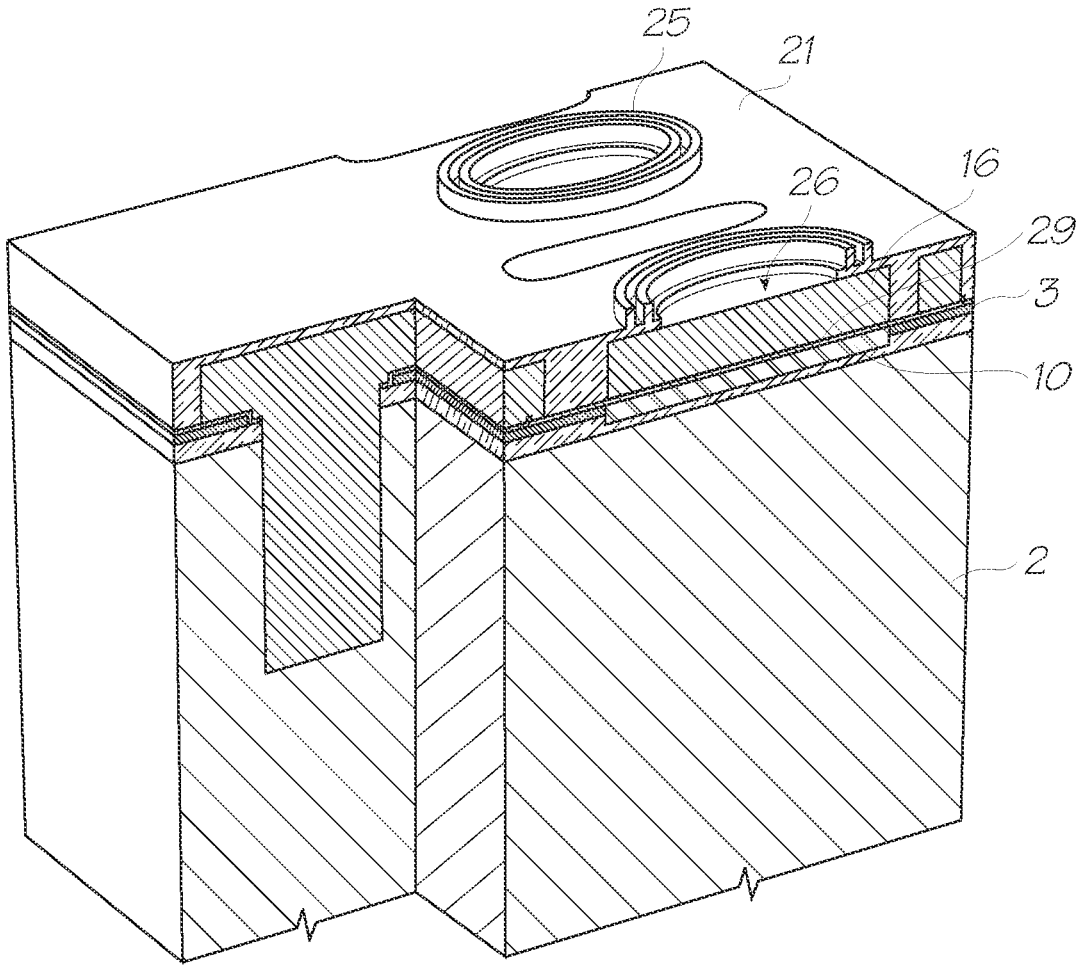
FIG. 11 is a perspective of the nozzle assembly shown in FIG. 10.

Referring to FIGS. 9 to 11, the next stage defines an elliptical nozzle aperture 26 in the roof 21 by etching all the way through the remaining roof material, which is bounded by the rim 25. This etch is defined using a layer of photoresist (not shown) exposed by the dark tone roof mask shown in FIG. 9. The elliptical nozzle aperture 26 is positioned over the thermal actuator 29, as shown in FIG. 11.

Figure 12:
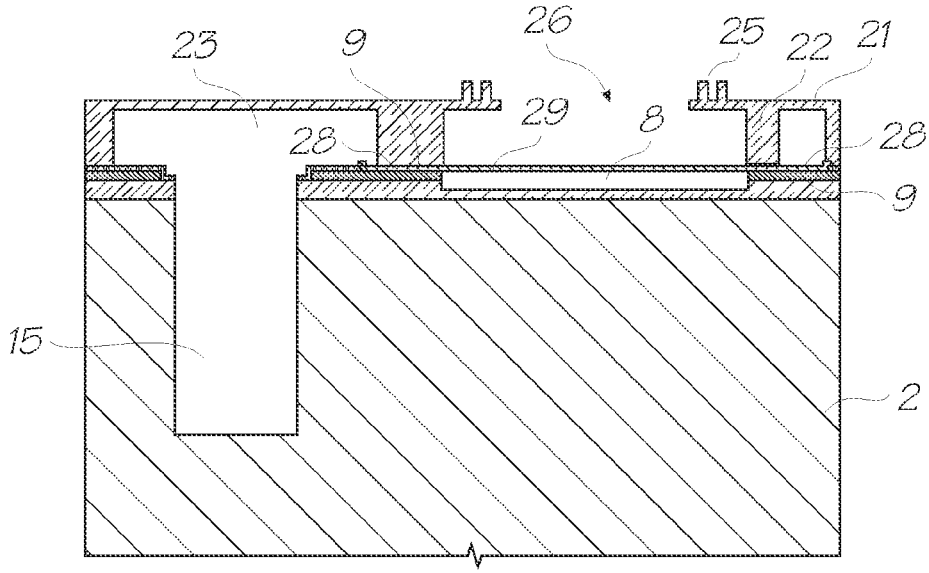
FIG. 12 shows the oxygen plasma ashing of the first and second sacrificial layers.
Figure 13:
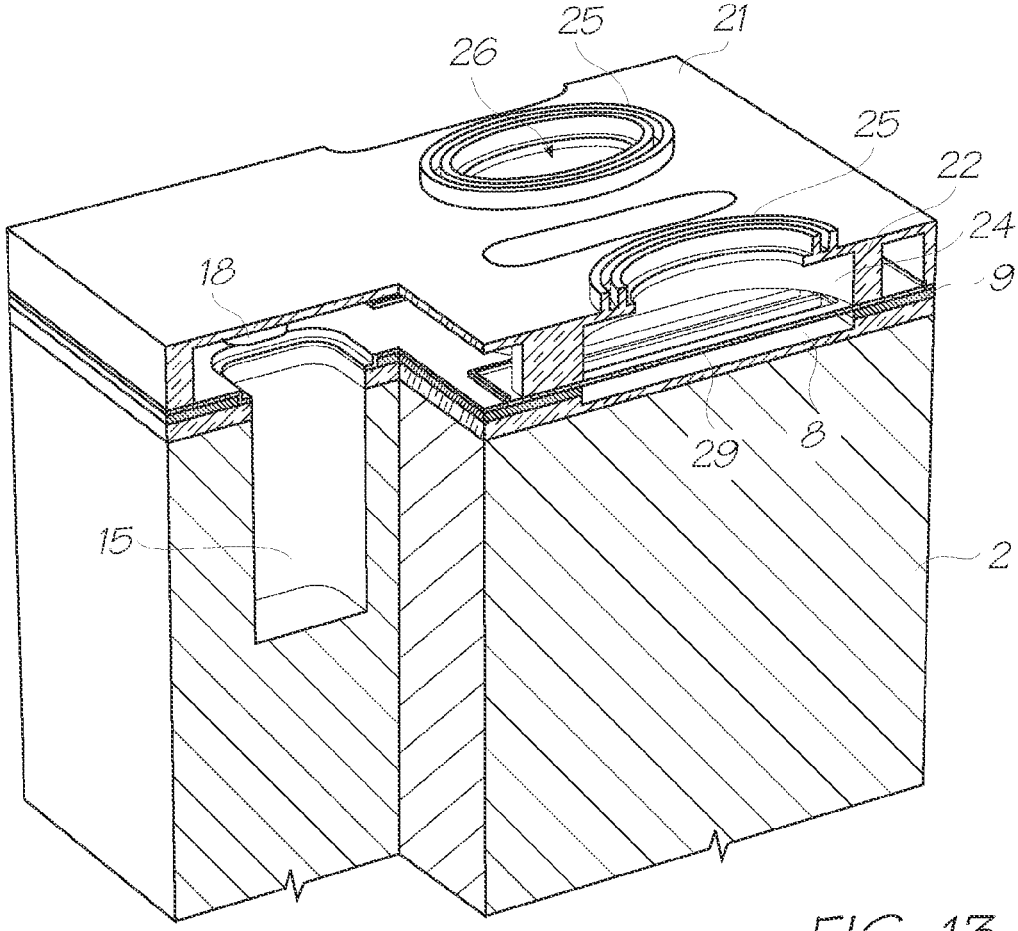
FIG. 13 is a perspective of the nozzle assembly shown in FIG. 12.
Figure 14:
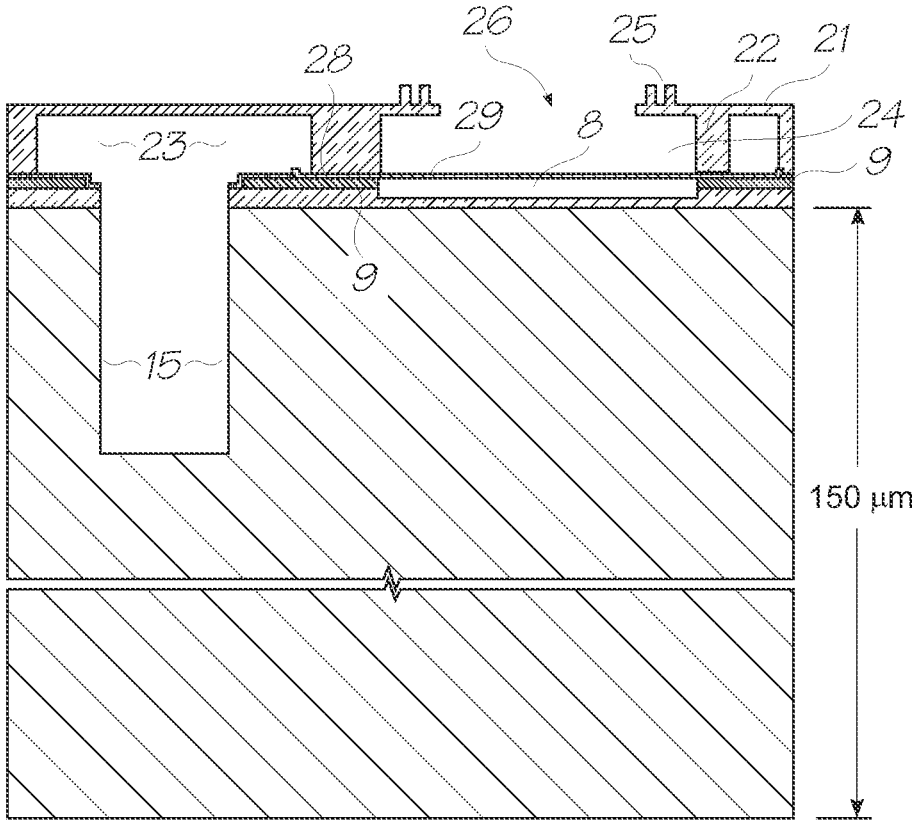
FIG. 14 shows the nozzle assembly after the ashing, as well as the opposing side of the wafer.
Figure 15:
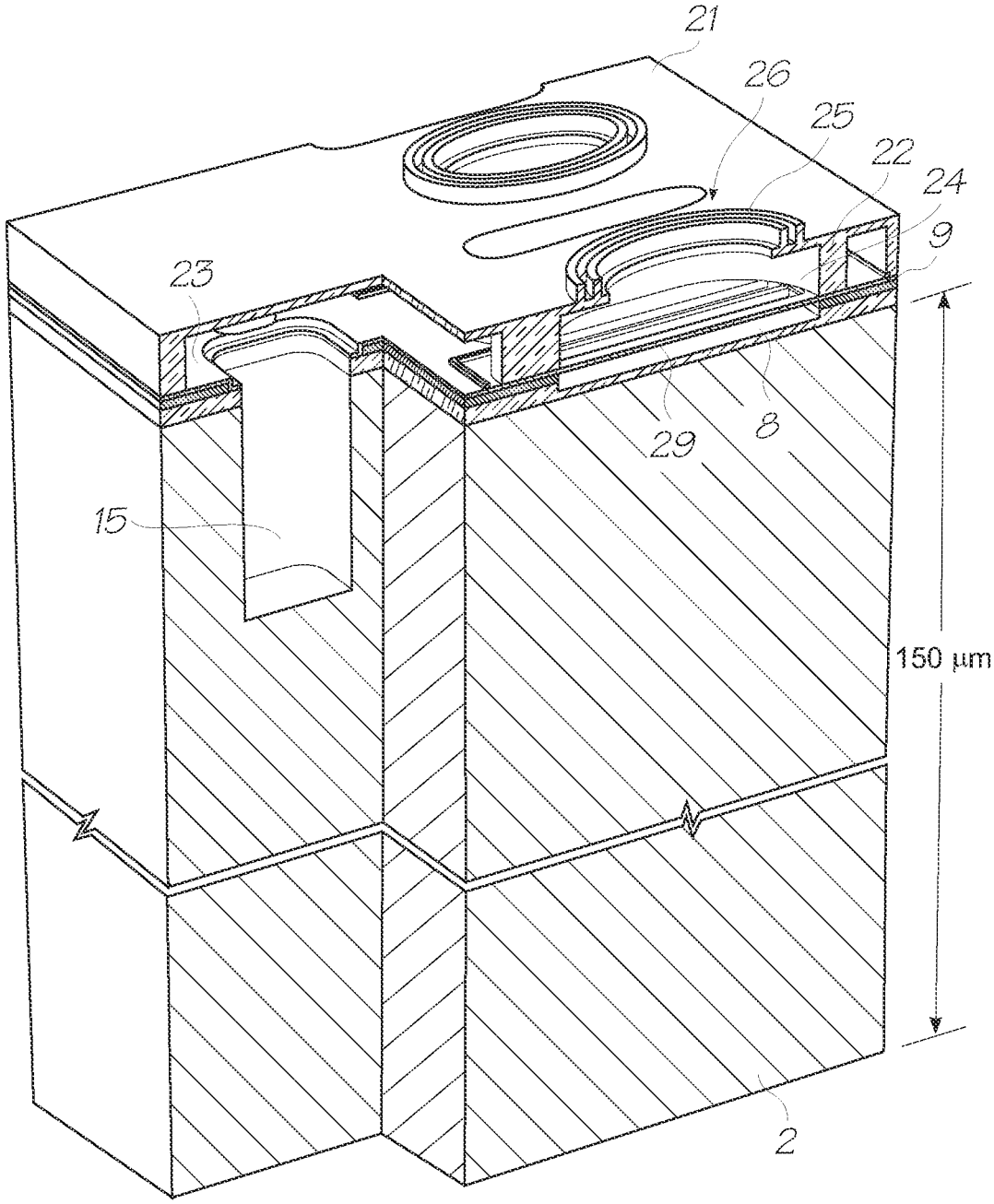
FIG. 15 is a perspective of the nozzle assembly shown in FIG. 14.

With all the MEMS nozzle features now fully formed, the next stage removes the SAC1 and SAC2 photoresist layers 10 and 16 by $O_2$ plasma ashing (FIGS. 12 and 13). FIGS. 14 and 15 show the entire thickness (150 microns) of the silicon wafer 2 after ashing the SAC1 and SAC2 photoresist layers 10 and 16.

Figure 16:
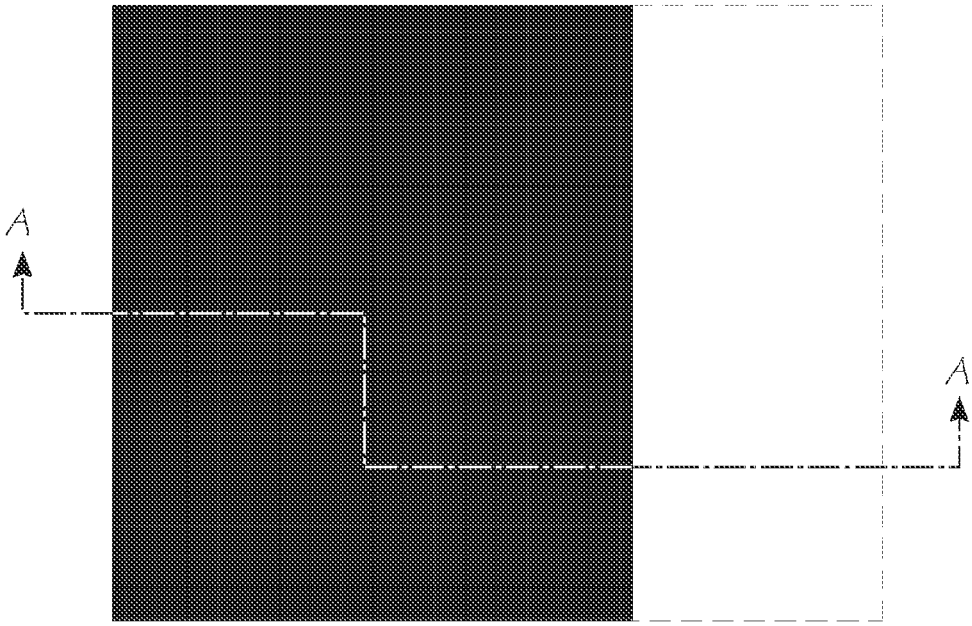
FIG. 16 is the mask associated with the backside etch shown in FIG. 17.
Figure 17:
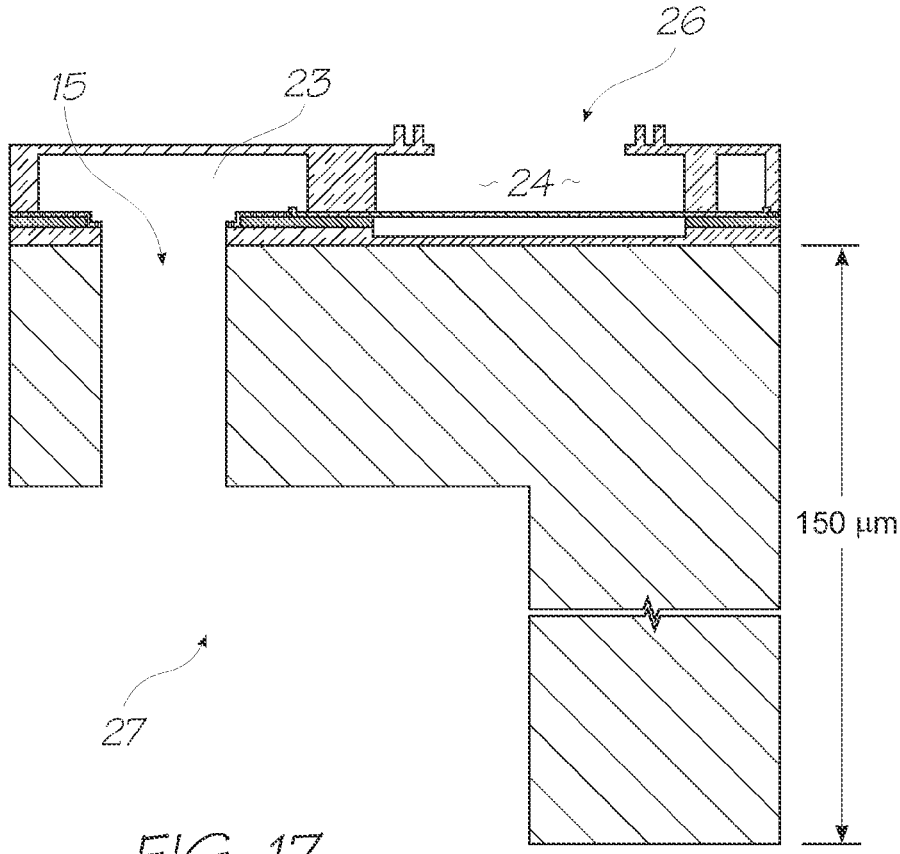
FIG. 17 shows the backside etch of the ink supply channel into the wafer.
Figure 18:
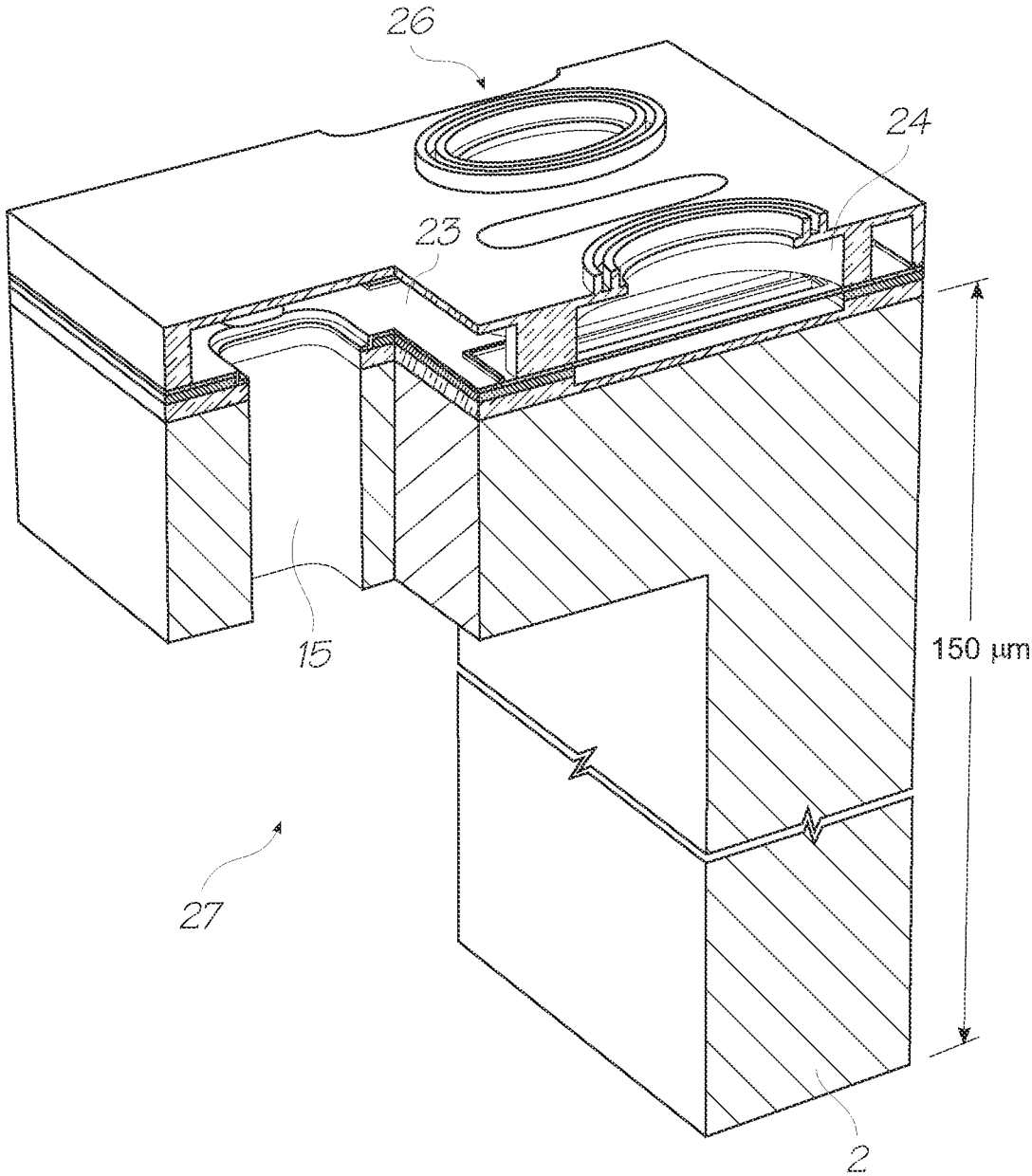
FIG. 18 is a perspective of the nozzle assembly shown in FIG. 17.

Referring to FIGS. 16 to 18, once frontside MEMS processing of the wafer is completed, ink supply channels 27 are etched from the backside of the wafer to meet with the ink inlets 15 using a standard anisotropic DRIE. This backside etch is defined using a layer of photoresist (not shown) exposed by the dark tone mask shown in FIG. 16. The ink supply channel 27 makes a fluidic connection between the backside of the wafer and the ink inlets 15.

Finally, and referring to FIGS. 2 and 3, the wafer is thinned to about 135 microns by backside etching. FIG. 1 shows three adjacent rows of nozzles in a cutaway perspective view of a completed printhead integrated circuit. Each row of nozzles has a respective ink supply channel 27 extending along its length and supplying ink to a plurality of ink inlets 15 in each row. The ink inlets, in turn, supply ink to the ink conduit 23 for each row, with each nozzle chamber receiving ink from a common ink conduit for that row.

As already discussed above, this prior art MEMS fabrication process inevitably leaves a hydrophilic ink ejection face by virtue of the nozzle surface 56 being formed of ceramic materials, such as silicon dioxide, silicon nitride, silicon oxynitride, aluminium nitride etc.

In a preferred process for hydrophobizing the nozzle surface 56 (and as described in US 2009/0139961, the contents of which are incorporated herein by reference), the wafer is coated with a hydrophobic polymer 80 immediately after the nozzle rim etch at the stage exemplified in FIGS. 7 and 8.

Figure 19:
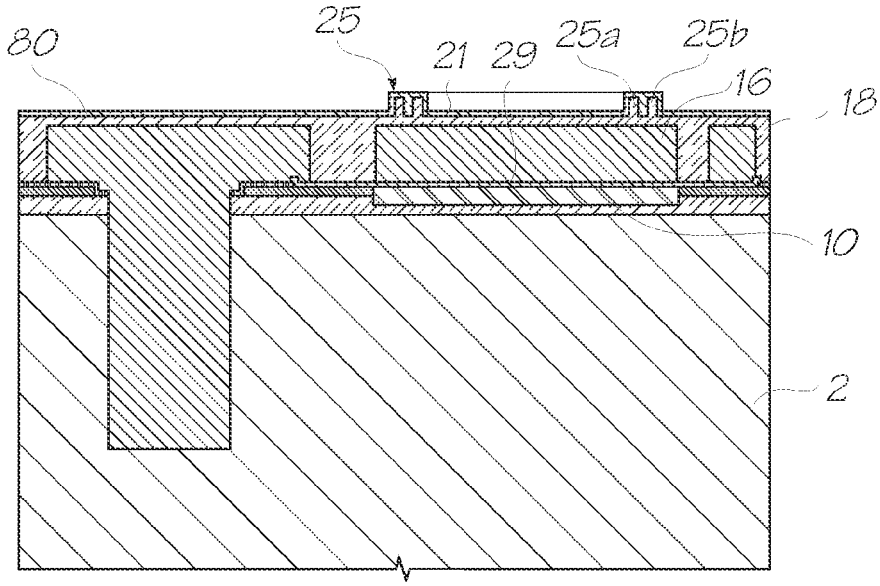
FIG. 19 shows the nozzle assembly of FIG. 7 after deposition of a hydrophobic polymeric coating.
Figure 20:
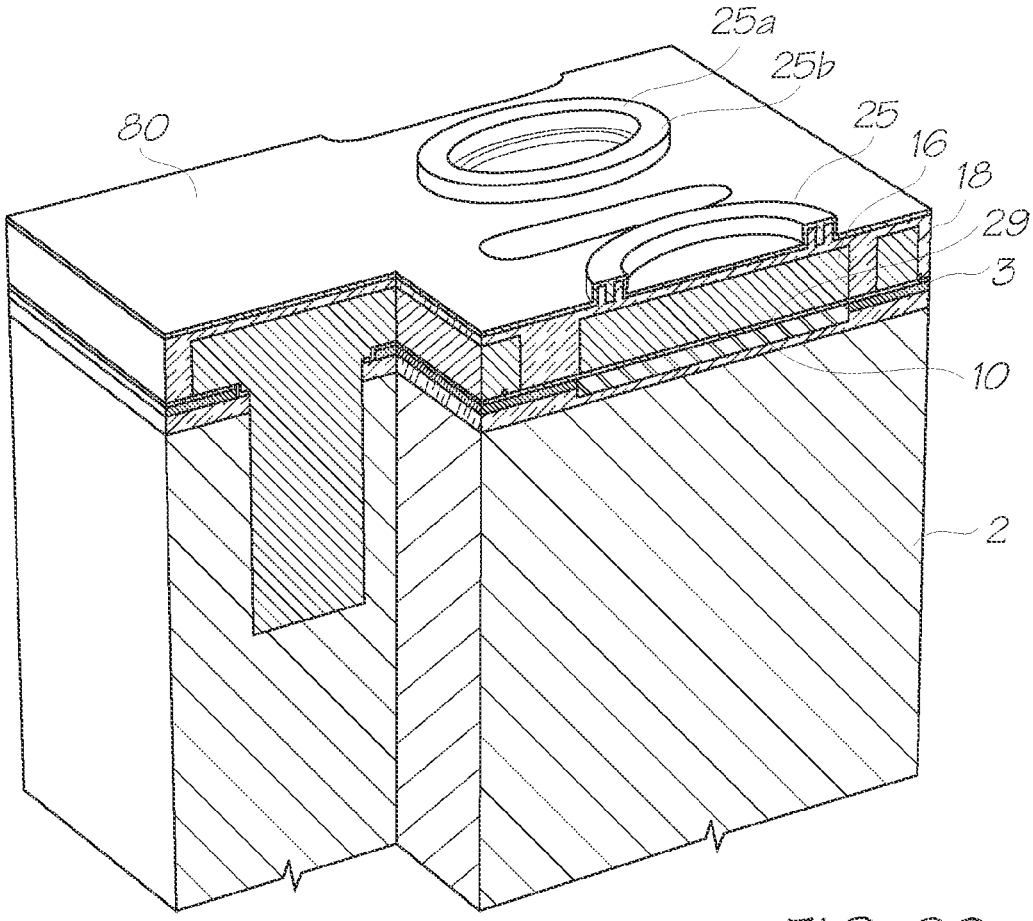
FIG. 20 is a perspective of the nozzle assembly shown in FIG. 19.

A thin layer (about 1 to 2 microns) of the hydrophobic polymer 100 is spun onto the wafer and hardbaked to provide the partially-fabricated printhead shown in FIGS. 19 and 20.

Figure 21:
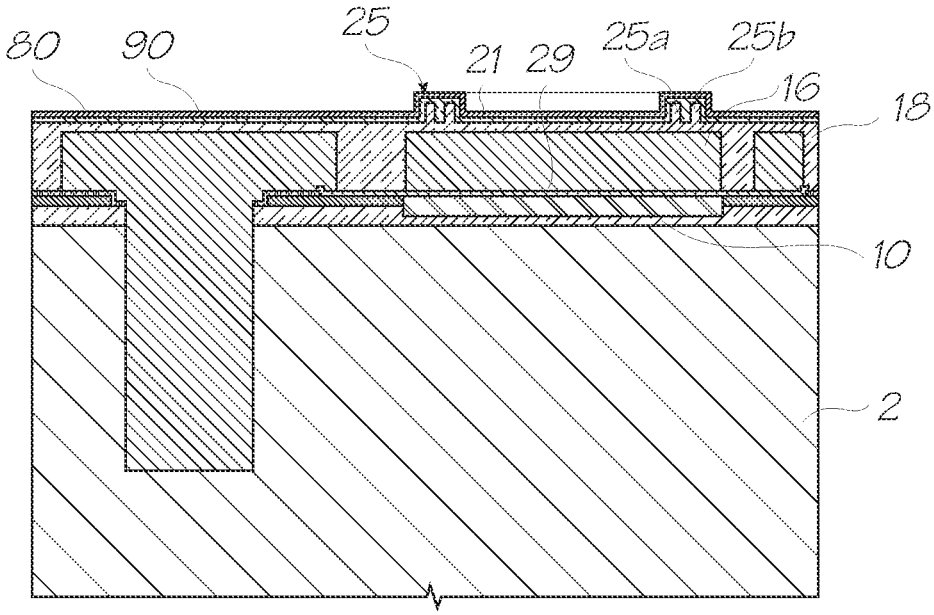
FIG. 21 shows the nozzle assembly of FIG. 19 after deposition of a protective metal film.

Referring now to FIG. 21, a protective metal film 90 (ca. 100 nm thickness) is then deposited onto the polymer layer 80. The metal film is typically comprised of titanium or aluminium and protects the hydrophobic polymer 80 from late-stage oxygen ashing conditions. Hence, the polymer layer 80 is not exposed to aggressive ashing conditions and retains its hydrophobic characteristics throughout the MEMS processing steps.

Figure 22:
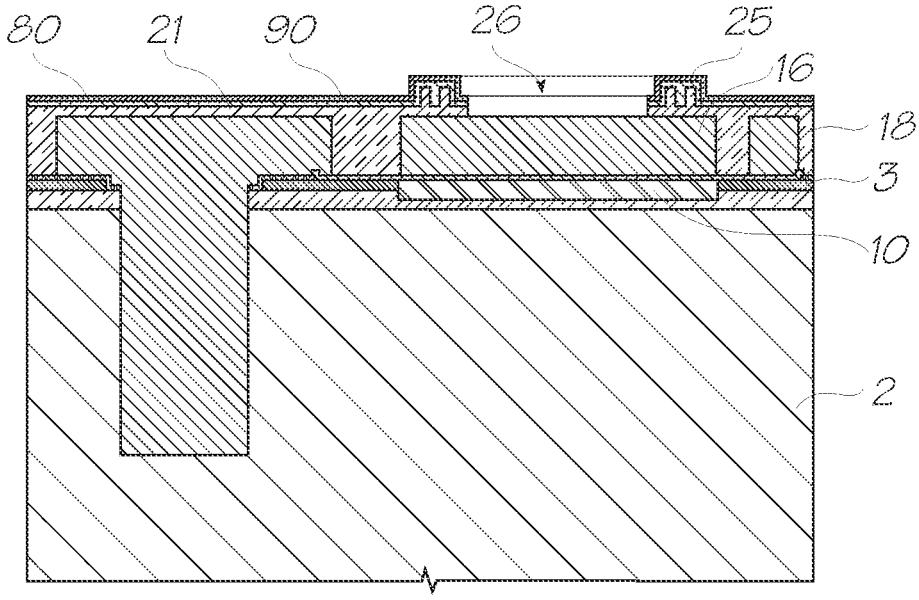
FIG. 22 shows the nozzle assembly of FIG. 21 after etching through the protective metal film, the polymeric coating and the nozzle roof.

FIG. 22 shows the wafer after etching the nozzle opening 26 through the metal film 110, the polymer layer 80 and the nozzle roof 21. This etching step utilizes a conventional patterned photoresist layer (not shown) as a common mask for all nozzle etching steps. In a typical etching sequence, the metal film 90 is first etched, either by standard dry metal-etching (e.g. $BCl_3/Cl_2$) or wet metal-etching (e.g. $H_2O_2$ or HF). A second dry etch is then used to etch through the polymer layer 80 and the nozzle roof 21. Typically, the second etch step is a dry etch employing $O_2$ and a fluorinated etching gas (e.g. $SF_6$ or $CF_4$).

Figure 23:
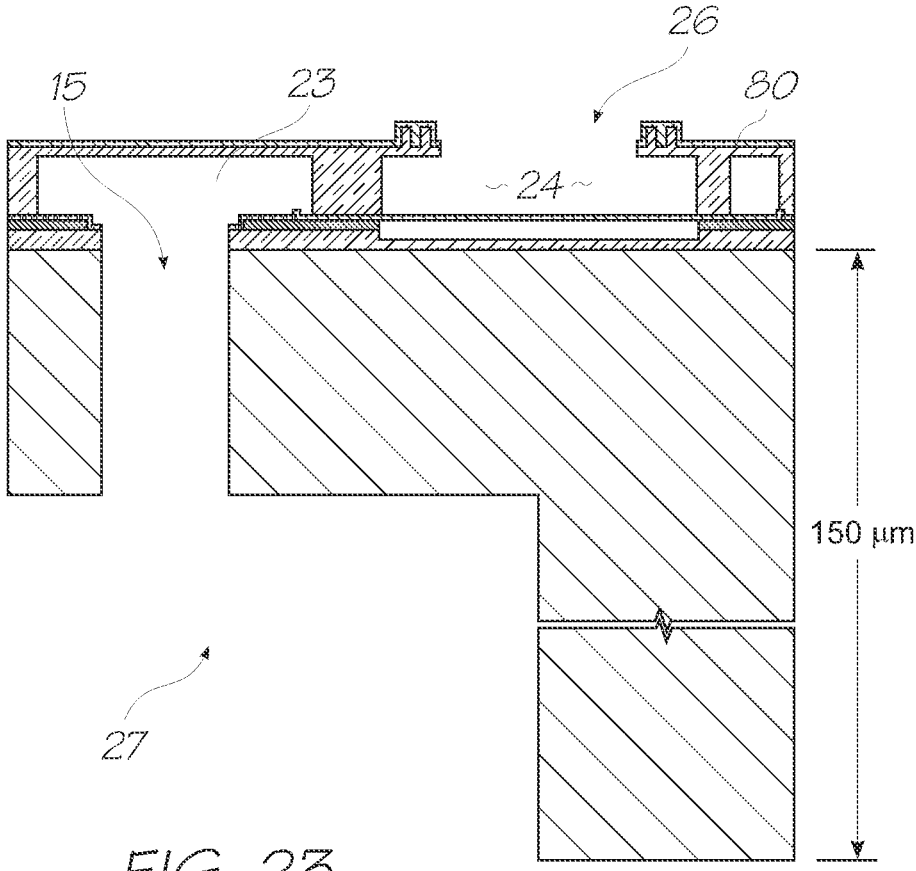
FIG. 23 shows the completed nozzle assembly after backside MEMS processing and removal of photoresist.
Figure 24:
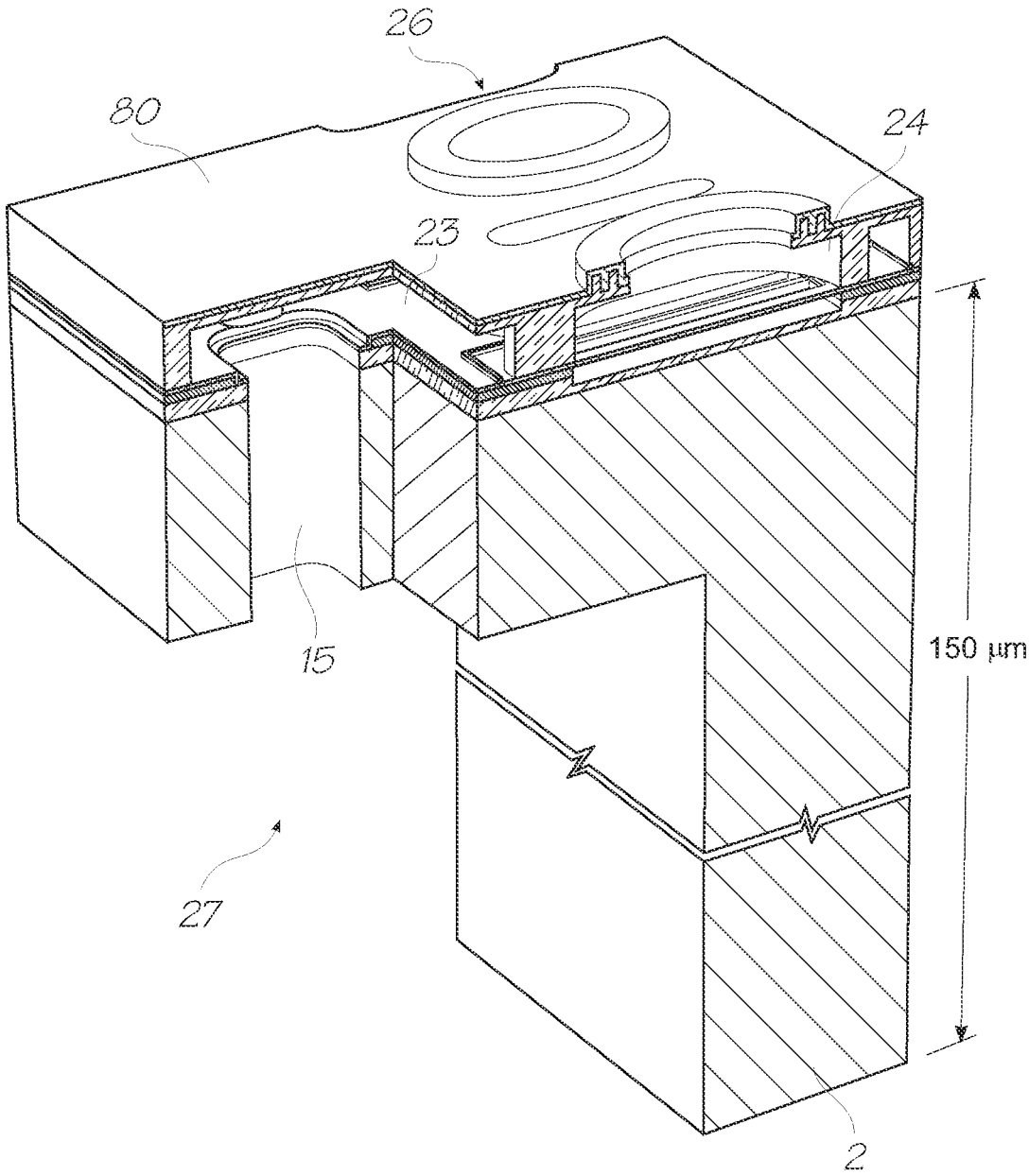
FIG. 24 is a perspective of the nozzle assembly shown in FIG. 23.

Once the nozzle opening 26 is defined as shown in FIG. 22, backside MEMS processing steps (e.g. etching ink supply channels, wafer thinning etc) and late-stage ashing of photoresist can proceed in accordance with known protocols, analogous to the steps described above in connection with FIGS. 14 to 18. Final removal of the metal film 90 using a $H_2O_2$ or HF rinse yields the completed nozzle assembly shown in FIGS. 23 and 24, having the hydrophobic polymer layer 80.

Thermal Bend Actuator Printhead

From the foregoing, it will be appreciated that any type of printhead may be hydrophobized in an analogous manner. However, the polymeric coatings are particularly advantageous for use in the Applicant's thermal bend actuator nozzle assemblies, because the polymer layer acts as a mechanical seal between a moving roof portion and a stationary body of the printhead. These advantages are discussed in greater detail in the Applicant's US Publication No. 2008/0225076, the contents of which are herein incorporated by reference.

FIGS. 25 to 37 shows a sequence of MEMS fabrication steps for an inkjet nozzle assembly 100 described in our earlier US Publication No. US 2008/0309728, the contents of which are herein incorporated by reference. The completed inkjet nozzle assembly 100 shown in FIGS. 36 and 37 utilizes thermal bend actuation, whereby a moving portion of a roof bends towards a substrate resulting in ink ejection.

The starting point for MEMS fabrication is a standard CMOS wafer having CMOS drive circuitry formed in an upper portion of a silicon wafer. At the end of the MEMS fabrication process, this wafer is diced into individual printhead integrated circuits (ICs), with each IC comprising drive circuitry and plurality of nozzle assemblies.

Figure 25:
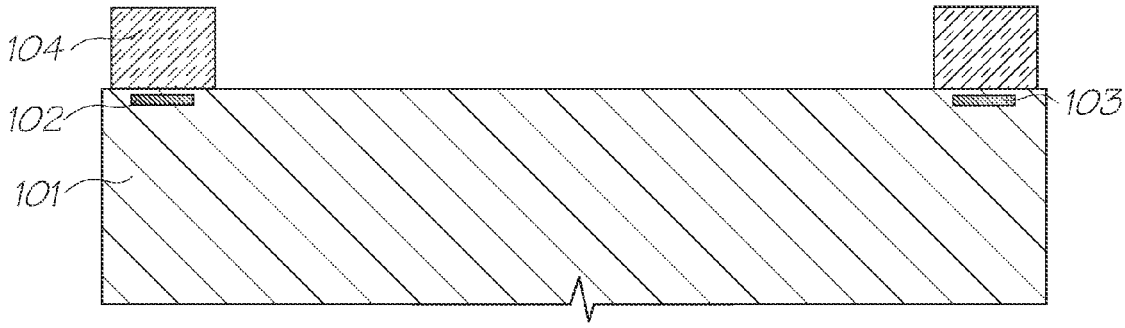
FIG. 25 is a side-sectional view of a partially-fabricated alternative inkjet nozzle assembly after a first sequence of steps in which nozzle chamber sidewalls are formed.
Figure 26:
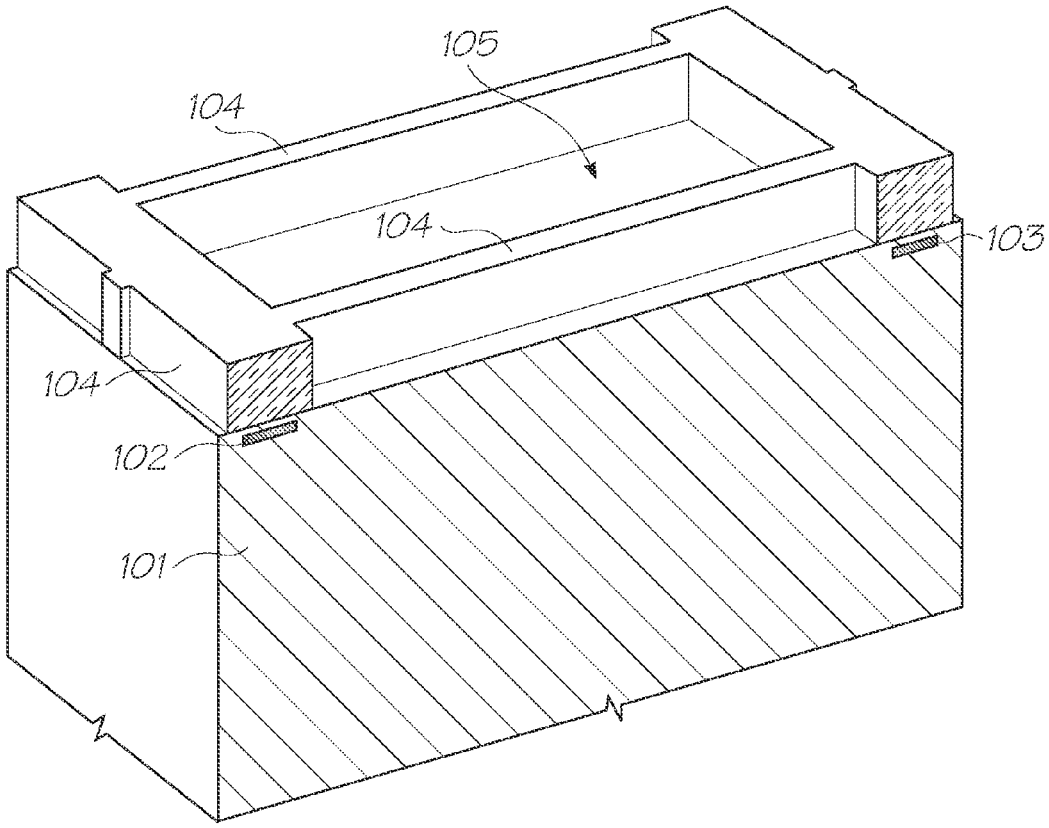
FIG. 26 is a perspective view of the partially-fabricated inkjet nozzle assembly shown in FIG. 25.

As shown in FIGS. 25 and 26, a substrate 101 has an electrode 102 formed in an upper portion thereof. The electrode 102 is one of a pair of adjacent electrodes (positive and earth) for supplying power to an actuator of the inkjet nozzle 100. The electrodes receive power from CMOS drive circuitry (not shown) in upper layers of the substrate 101.

The other electrode 103 shown in FIGS. 25 and 26 is for supplying power to an adjacent inkjet nozzle. In general, the drawings shows MEMS fabrication steps for a nozzle assembly, which is one of an array of nozzle assemblies. The following description focuses on fabrication steps for one of these nozzle assemblies. However, it will of course be appreciated that corresponding steps are being performed simultaneously for all nozzle assemblies that are being formed on the wafer. Where an adjacent nozzle assembly is partially shown in the drawings, this can be ignored for the present purposes. Accordingly, the electrode 103 and all features of the adjacent nozzle assembly will not be described in detail herein. Indeed, in the interests of clarity, some MEMS fabrication steps will not be shown on adjacent nozzle assemblies.

In the sequence of steps shown in FIGS. 25 and 26, an 8 micron layer of silicon dioxide is initially deposited onto the substrate 101. The depth of silicon dioxide defines the depth of a nozzle chamber 105 for the inkjet nozzle. After deposition of the $SiO_2$ layer, it is etched to define walls 104, which will become sidewalls of the nozzle chamber 105, shown most clearly in FIG. 26.

Figure 27:
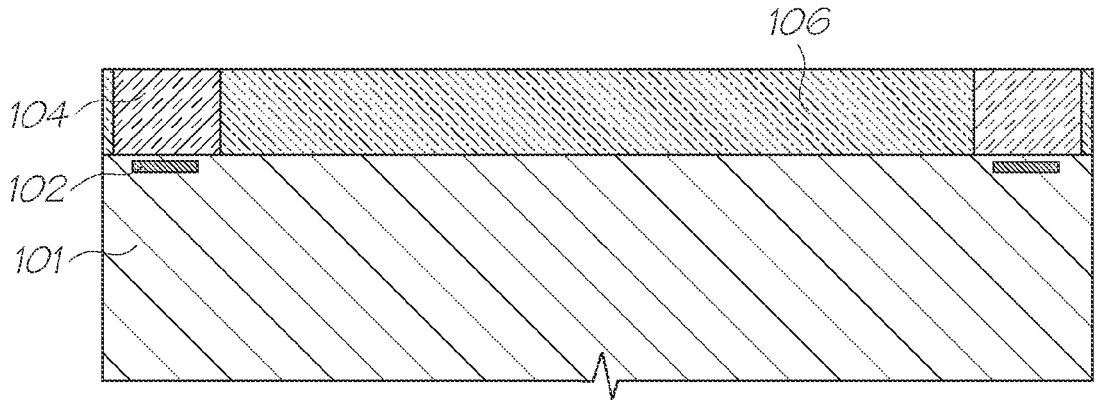
FIG. 27 is a side-sectional view of a partially-fabricated inkjet nozzle assembly after a second sequence of steps in which the nozzle chamber is filled with polyimide.
Figure 28:
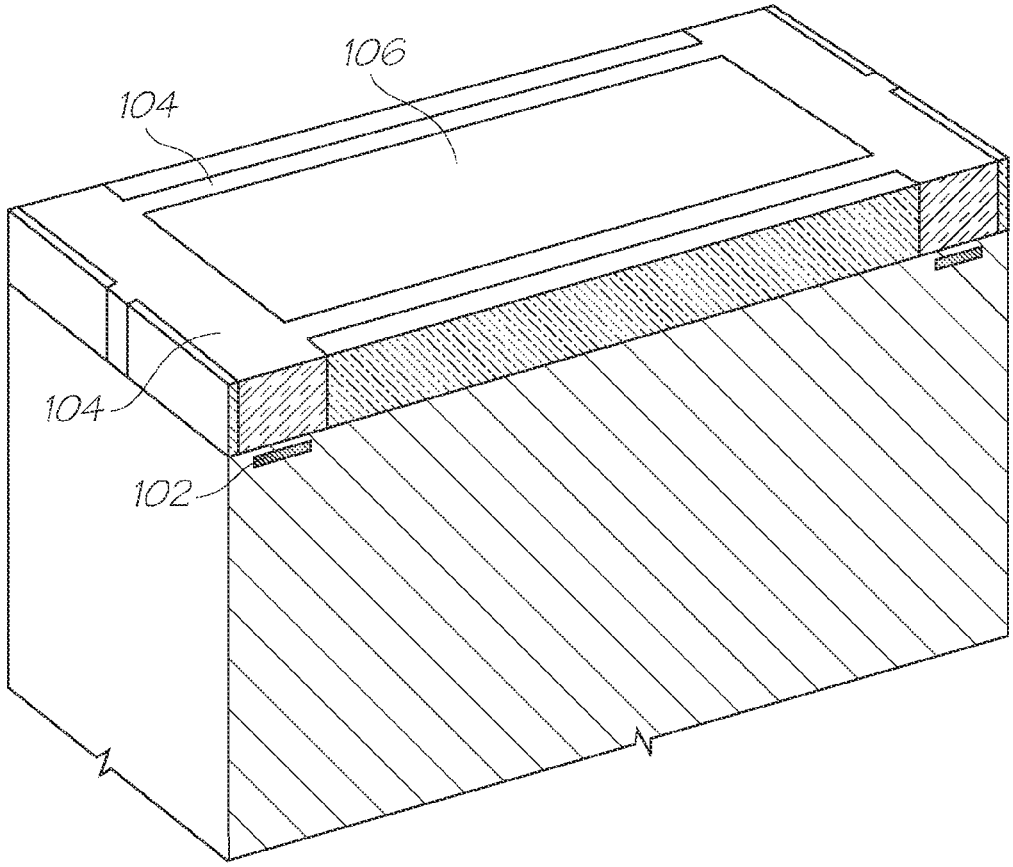
FIG. 28 is a perspective view of the partially-fabricated inkjet nozzle assembly shown in FIG. 27.

As shown in FIGS. 27 and 28, the nozzle chamber 105 is then filled with photoresist or polyimide 106, which acts as a sacrificial scaffold for subsequent deposition steps. The polyimide 106 is spun onto the wafer using standard techniques, UV cured and/or hardbaked, and then subjected to chemical mechanical planarization (CMP) stopping at the top surface of the $SiO_2$ wall 104.

Figure 29:
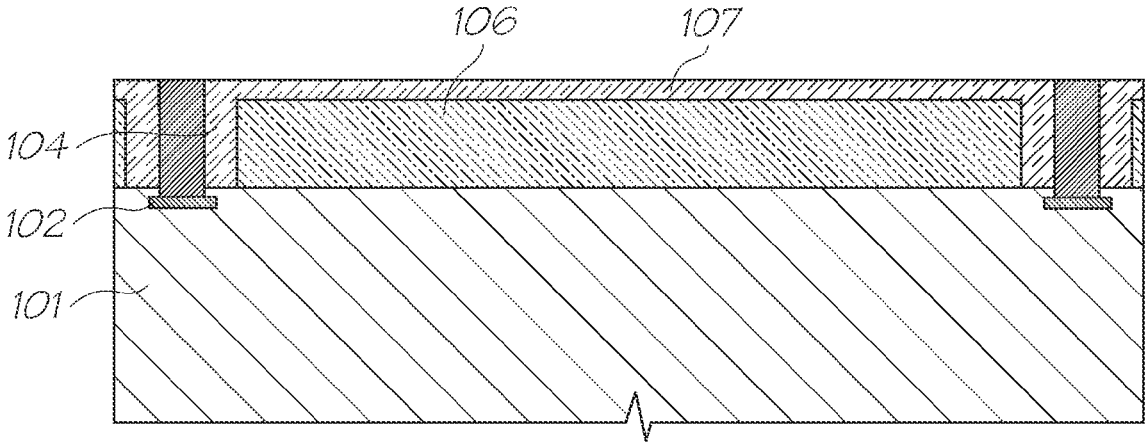
FIG. 29 is a side-sectional view of a partially-fabricated inkjet nozzle assembly after a third sequence of steps in which connector posts are formed up to a chamber roof.
Figure 30:
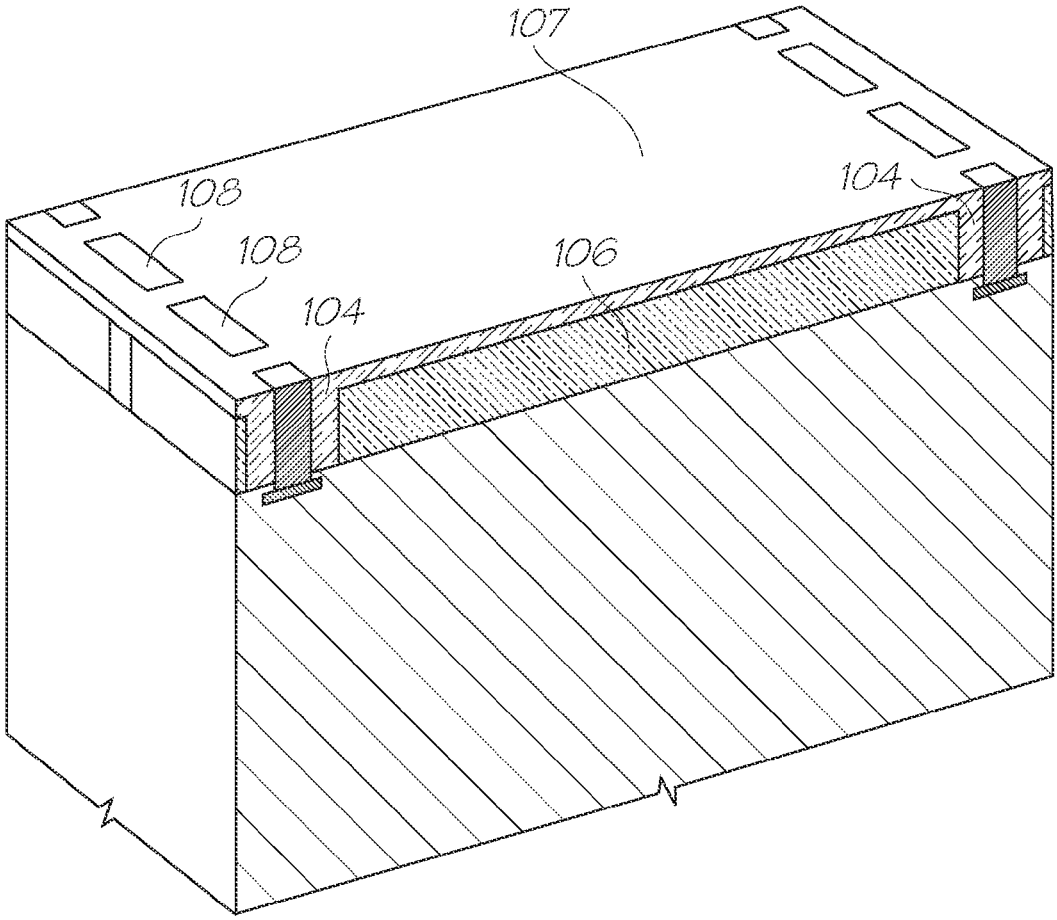
FIG. 30 is a perspective view of the partially-fabricated inkjet nozzle assembly shown in FIG. 29.

In FIGS. 29 and 30, a roof member 107 of the nozzle chamber 105 is formed as well as highly conductive connector posts 108 extending down to the electrodes 102. Initially, a 1.7 micron layer of $SiO_2$ is deposited onto the polyimide 106 and wall 104. This layer of $SiO_2$ defines a roof 107 of the nozzle chamber 105. Next, a pair of vias are formed in the wall 104 down to the electrodes 102 using a standard anisotropic DRIE. This etch exposes the pair of electrodes 102 through respective vias. Next, the vias are filled with a highly conductive metal, such as copper, using electroless plating. The deposited copper posts 108 are subjected to CMP, stopping on the $SiO_2$ roof member 107 to provide a planar structure. It can be seen that the copper connector posts 108, formed during the electroless copper plating, meet with respective electrodes 102 to provide a linear conductive path up to the roof member 107.

Figure 31:
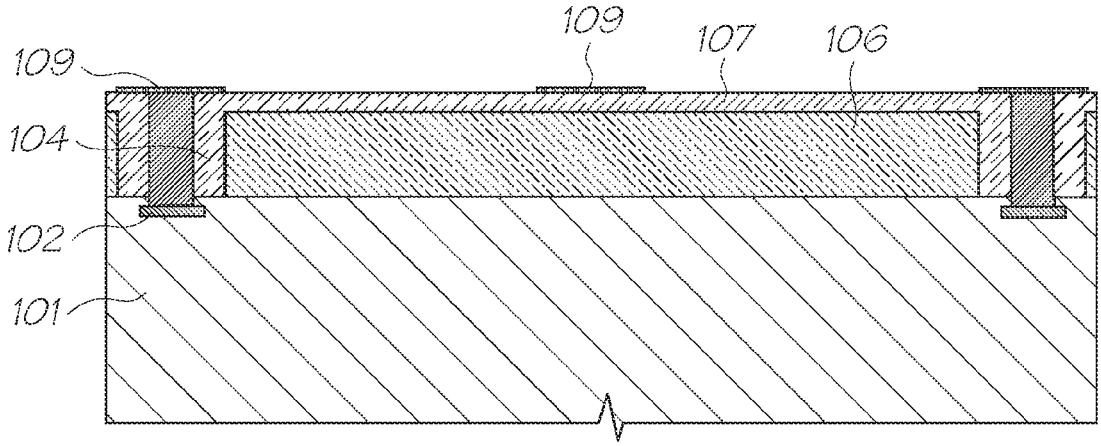
FIG. 31 is a side-sectional view of a partially-fabricated inkjet nozzle assembly after a fourth sequence of steps in which conductive metal plates are formed.
Figure 32:
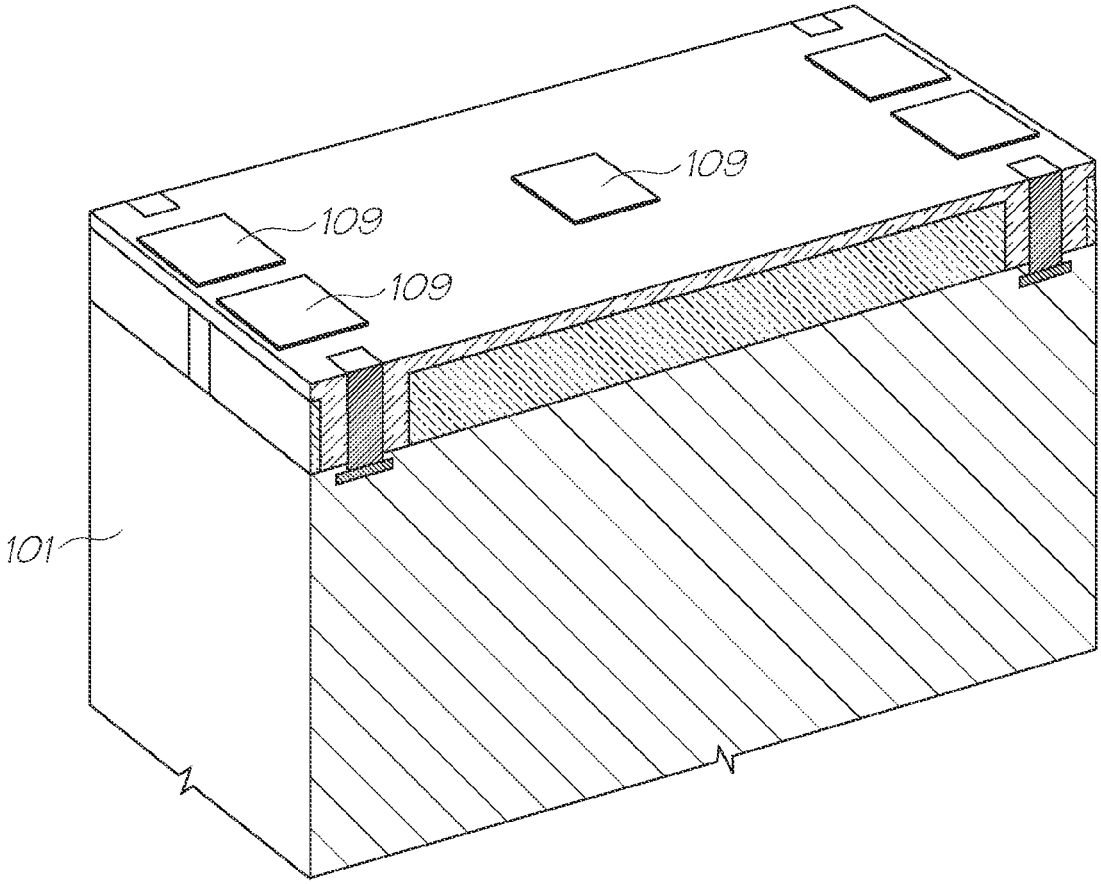
FIG. 32 is a perspective view of the partially-fabricated inkjet nozzle assembly shown in FIG. 31.

In FIGS. 31 and 32, metal pads 109 are formed by initially depositing a 0.3 micron layer of aluminium onto the roof member 107 and connector posts 108. Any highly conductive metal (e.g. aluminium, titanium etc.) may be used and should be deposited with a thickness of about 0.5 microns or less so as not to impact too severely on the overall planarity of the nozzle assembly. The metal pads 109 are positioned over the connector posts 108 and on the roof member 107 in predetermined 'bend regions' of the thermoelastic active beam member.

Figure 33:
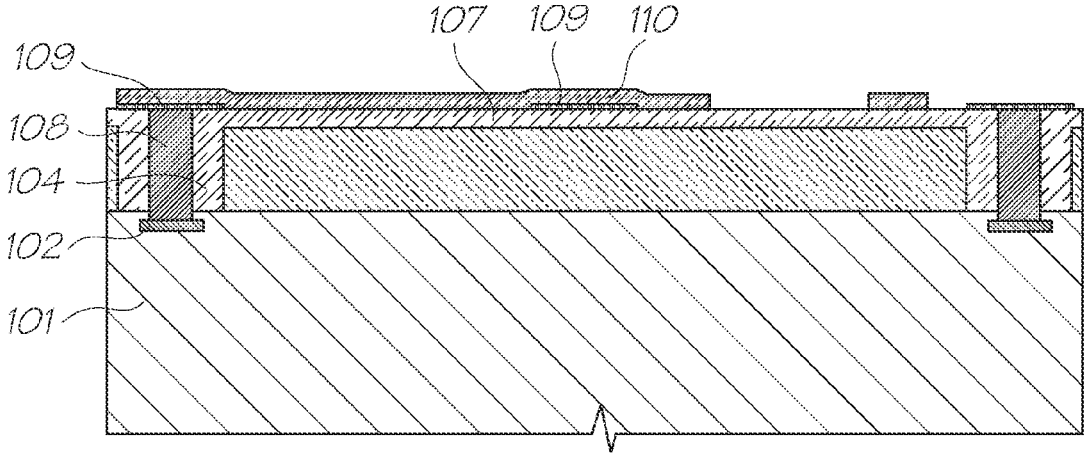
FIG. 33 is a side-sectional view of a partially-fabricated inkjet nozzle assembly after a fifth sequence of steps in which an active beam member of a thermal bend actuator is formed.
Figure 34:
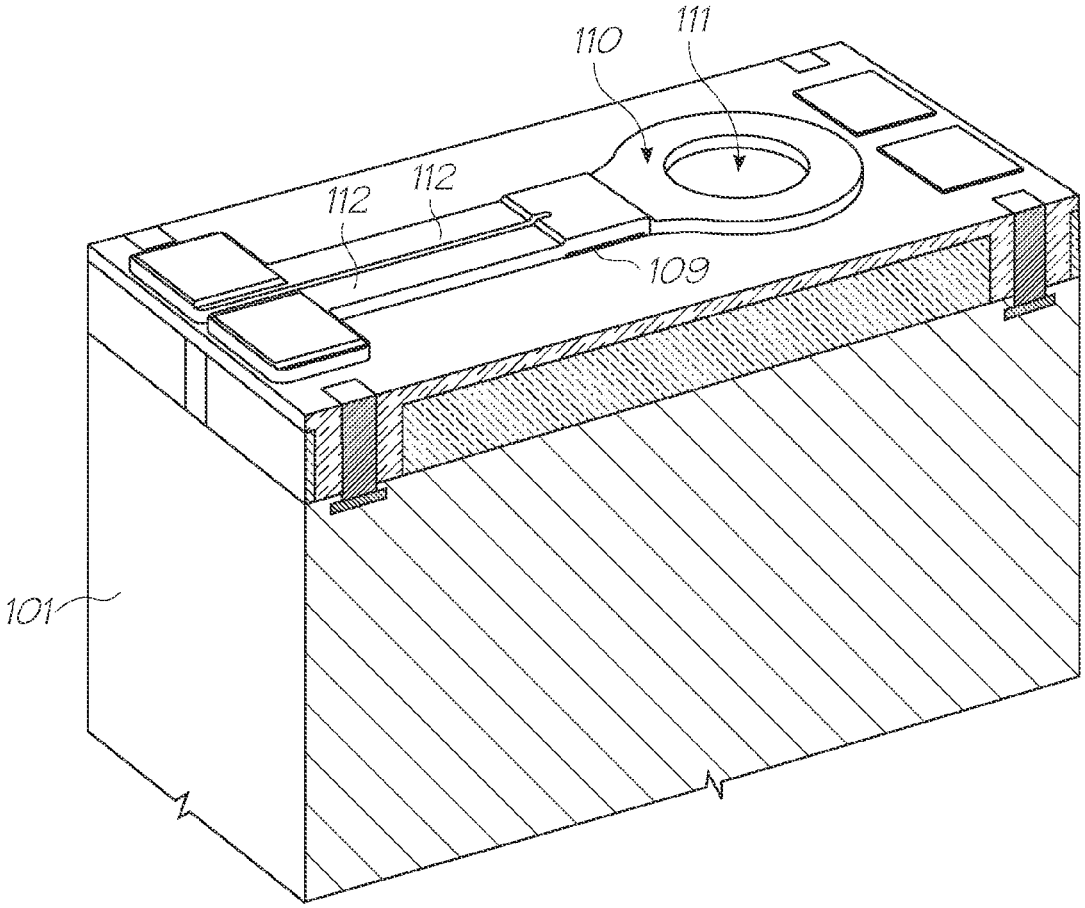
FIG. 34 is a perspective view of the partially-fabricated inkjet nozzle assembly shown in FIG. 33.

In FIGS. 33 and 34, a thermoelastic active beam member 110 is formed over the $SiO_2$ roof 107. By virtue of being fused to the active beam member 110, part of the $SiO_2$ roof member 107 functions as a lower passive beam member 116 of a mechanical thermal bend actuator, which is defined by the active beam 110 and the passive beam 116. The thermoelastic active beam member 110 may be comprised of any suitable thermoelastic material, such as titanium nitride, titanium aluminium nitride and aluminium alloys. As explained in the Applicant's earlier US Publication No. 2008/0129793 (the contents of which are herein incorporated by reference), vanadium-aluminium alloys are a preferred material, because they combine the advantageous properties of high thermal expansion, low density and high Young's modulus.

To form the active beam member 110, a 1.5 micron layer of active beam material is initially deposited by standard PECVD. The beam material is then etched using a standard metal etch to define the active beam member 110. After completion of the metal etch and as shown in FIGS. 33 and 34, the active beam member 110 comprises a partial nozzle opening 111 and a beam element 112, which is electrically connected at each end to positive and ground electrodes 102 via the connector posts 108. The planar beam element 112 extends from a top of a first (positive) connector post and bends around 180 degrees to return to a top of a second (ground) connector post.

Still referring to FIGS. 33 and 34, the metal pads 109 are positioned to facilitate current flow in regions of potentially higher resistance. One metal pad 109 is positioned at a bend region of the beam element 112, and is sandwiched between the active beam member 110 and the passive beam member 116. The other metal pads 109 are positioned between the top of the connector posts 108 and the ends of the beam element 112.

Figure 35:
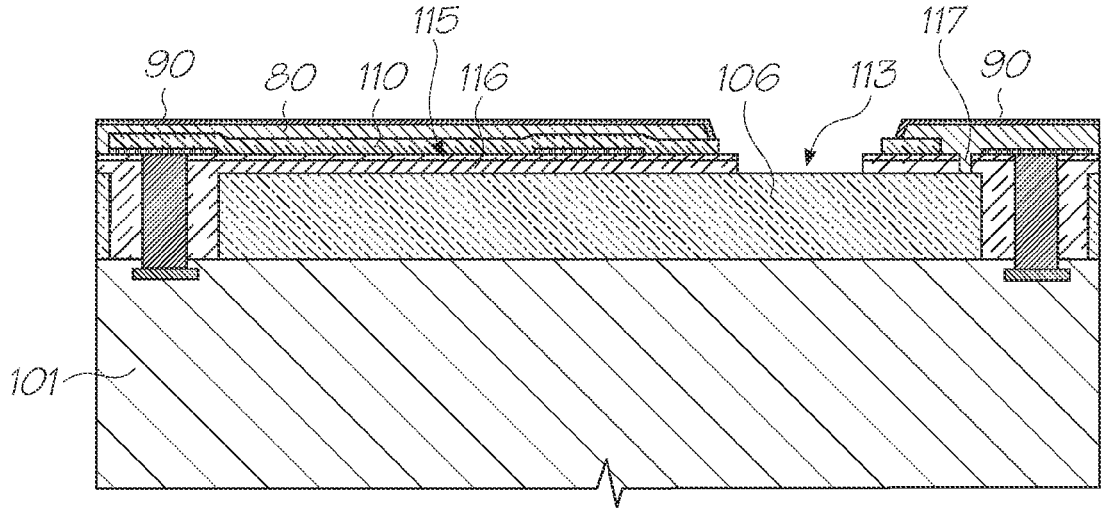
FIG. 35 is a side-sectional view of a partially-fabricated inkjet nozzle assembly after a sixth sequence of steps after coating with a polymeric layer, protecting with a metal layer and etching a nozzle opening.

Referring to FIG. 35, a hydrophobic polymer layer 80 is deposited onto the wafer and covered with a protective metal layer 90 (e.g. 100 nm aluminum). After suitable masking, the metal layer 90, the polymer layer 80 and the $SiO_2$ roof member 107 are then etched to define fully a nozzle opening 113 and a moving portion 114 of the roof The etch is typically a two-stage etch process as described above in connection with FIG. 22.

The moving portion 114 comprises a thermal bend actuator 115, which is itself comprised of the active beam member 110 and the underlying passive beam member 116. The nozzle opening 113 is defined in the moving portion 114 of the roof so that the nozzle opening moves with the actuator during actuation. Configurations whereby the nozzle opening 113 is stationary with respect to the moving portion 114, as described in US Publication No. 2008/0129793, are also possible and within the ambit of the present invention.

A perimeter space or gap 117 around the moving portion 114 of the roof separates the moving portion from a stationary portion 118 of the roof. This gap 117 allows the moving portion 114 to bend into the nozzle chamber 105 and towards the substrate 101 upon actuation of the actuator 115. The hydrophobic polymer layer 80 fills the gap 117 to provide a mechanical seal between the moving portion 114 and stationary portion 118 of the roof 107. The polymer has a sufficiently low Young's modulus to allow the actuator to bend towards the substrate 101, whilst preventing ink from escaping through the gap 117 during actuation.

Figure 36:
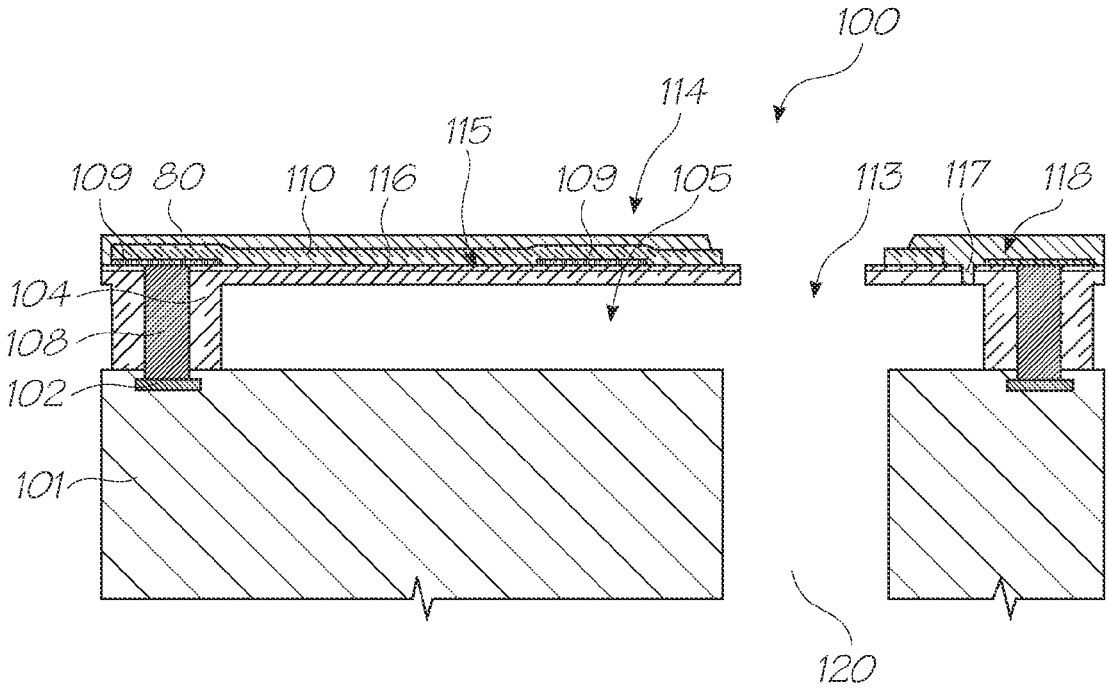
FIG. 36 is a side-sectional view of completed inkjet nozzle assembly, after backside MEMS processing and removal of photoresist.
Figure 37:
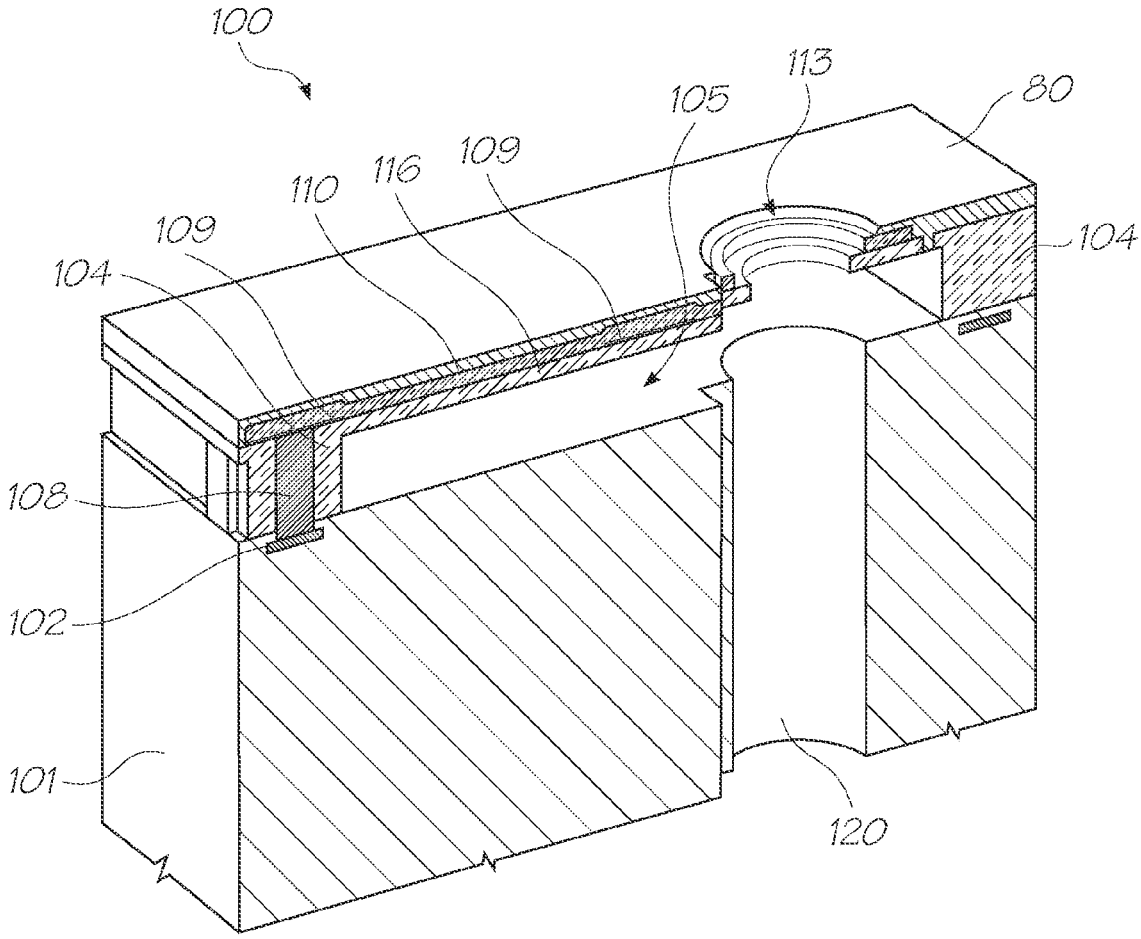
FIG. 37 is a cutaway perspective view of the inkjet nozzle assembly shown in FIG. 36.

In the final MEMS processing steps, and as shown in FIGS. 36 and 37, an ink supply channel 120 is etched through to the nozzle chamber 105 from a backside of the substrate 101. Although the ink supply channel 120 is shown aligned with the nozzle opening 113 in FIGS. 36 and 37, it could, of course, be positioned offset from the nozzle opening.

Following the ink supply channel etch, the polyimide 106, which filled the nozzle chamber 105, is removed by ashing in an oxidizing plasma and the metal film 90 is removed by an HF or $H_2O_2$ rinse to provide the nozzle assembly 100.

Polymer Layer Comprising MSQ

The hydrophobic polymer layer 80 has proven to be an important feature of the Applicant's printheads. Not only does it hydrophobize the front face of the printhead, which helps to improve overall print quality, it also assists with printhead maintenance by presenting a planar hydrophobic surface for a printhead maintenance means (e.g wiper blade) employed to maintain the printhead in an operable condition. Of course, in the case of the thermal bend-actuated printheads 100 described above, the polymer 80 provides the additional function of mechanically sealing the moving part of the nozzle from the body of the printhead.

Hitherto, the Applicant has proposed the use of polydimethylsiloxane (PDMS). This material can be readily incorporated in MEMS fabrication processes, has excellent hydrophobicity and a Young's modulus which allows efficient thermal bend actuation. However, PDMS has relatively poor wear-resistance and can be scratched or otherwise damaged by repeated contact with, for example, a wiper blade.

The Applicant has now found that polysilsesquioxanes provide superior wear-resistance to PDMS whilst still maintaining all the advantages of PDMS. Polysilsesquioxanes belong to the general class of polymers known as polymerized siloxanes or silicones, and have the empirical formula $(RSiO_{1.5})_n$, where R is hydrogen or an organic group and n is an integer representing the length of the polymer chain. The organic group may be $C_{1-12}$ alkyl (e.g. methyl), $C_{1-10}$ aryl (e.g phenyl) or $C_{1-16}$ arylalkyl (e.g benzyl). The polymer chain may be of any length known in the art (e.g. n is from 2 to 10,000).

Poyl(alkylsilsesquioxanes) and poly(arylsilsesquioxanes), such as poly(methylsilsesquioxane) and poly(phenylsilsesquioxane) have been shown to have excellent hydrophobicity, durability and wear-resistance when used as the polymer layer 80 in the Applicant's printheads. For example, printheads coated with MSQ or PSQ could be wiped clean without damage, even after ink and paper fibres were baked onto the printhead for 1 hour.

Poly(methylsilsesquioxane) is also known in the art as methylsilsequioxane, MSQ, MSSQ, PMSQ and PMSSQ. Poly(phenylsilsesquioxane) is also known in the art as phenylsilsequioxane, PSQ, PSSQ, PPSQ and PPSSQ. For the sake of brevity, the Applicant shall hereinafter refer to poly (methylsilsesquioxane) as MSQ and refer to poly(phenylsilsesquioxane) as PSQ.

MSQ has a low dielectric constant (k=2.7) and has been used previously as an insulating material. However, the use of MSQ as a hydrophobic coating for MEMS inkjet printheads was not previously known.

MSQ or PSQ may be incorporated into printheads as the polymer layer 80 by the MEMS fabrication process described above. A MSQ or PSQ solution is spun on to the wafer to a depth of about 0.5 to 5 microns (e.g. 1 micron) and then hardbaked to promote adhesion to the nozzle plate and to provide a durable ink ejection face for the printhead. Hardbaking may include a UV curing step. For example, a typical hardbaking process may comprise the following steps:

1. Contact bake@110° C. for 2 min immediately after coating
2. Contact bake@300° C. for 6.5 min
3. UV expose for 130 sec (~1300 mJ)
4. Oven cure for 1 hour (starting@180° C. and ramping up@~4° C./min)

Although the Applicant's hardbaking process described above provides MSQ-coated or PSQ-coated printheads having excellent durability, it will be appreciated that hardbaking may follow any conventional procedure.

MSQ and PSQ each have a Young's modulus of about 3 GPa, which is somewhat higher than that of PDMS. However, the Applicant has found that thermal bend-actuated printheads still operate efficiently when the polymer layer 80 is comprised of MSQ or PSQ, notwithstanding its higher Young's modulus. Moreover, the overall robustness of MSQ and PSQ usually outweighs any downsides arising from their higher Young's moduli. Of course, in thermal bubble-forming printheads where there are no moving parts, the Young's modulus of the polymeric layer 80 is irrelevant to nozzle actuation.

The present inventors consider that the use of MSQ or PSQ represents a significant breakthrough in inkjet printhead technology. Hydrophobizing inkjet printheads, especially those manufactured by a MEMS fabrication process, was seen as a very significant challenge for all industry players. The present Applicant has demonstrated that MSQ or PSQ may be incorporated into a MEMS fabrication process and provides a hydrophobic ink ejection face having excellent durability and wear-resistance. This desirable combination of features had not been achieved previously in the art.

Polymer Layer Containing Nanoparticles

Although, as described above, MSQ and PSQ have significant advantages over PDMS for use as a polymer coating, there may be some instances where PDMS is still the material of choice. For example, in low-powered thermally bend-actuated printheads, the lower Young's modulus of PDMS may be advantageous for minimizing drop ejection energies. It would be desirable to improve, for example, the wear-resistance characteristics of PDMS without comprising its low Young's modulus.

In other scenarios, the polymer coating of a printhead may have properties which do not suit the particular fluid being ejected from the printhead. It should be noted that thermal bend-actuated printheads may eject both aqueous and non-aqueous liquids (e.g. polymers for printing OLEDs), and the ink ejection face of the printhead may have characteristics which complement the inherent properties of the fluid being ejected. These properties may include, for example, the fluid's hydrophilicity, hydrophobicity, viscosity, surface tension and/or boiling point.

Alternatively, the ink ejection face may have characteristics which complement a particular type of printhead maintenance regime employed (e.g. printhead capping/wiping as described in U.S. application Ser. No. 12/014,772 incorporated herein by reference; or printhead flooding/non-contact maintenance as described in U.S. Pat. No. 7,401,886 incorporated herein by reference). For example, wear-resistance is important for printhead maintenance regimes involving contact with the printhead, but less important for non-contact maintenance regimes.

Alternatively, the ink ejection face may have characteristics which complement a particular type of nozzle actuator. For example, fatigue-resistance is important for thermal bend-actuators where the polymeric material seals a moving portion of the nozzle to the body of the printhead. However, fatigue-resistance is less important in non-moving nozzles, such as the thermal bubble-forming nozzles described above.

The ability to 'tune' the characteristics of the ink ejection face without changing fundamentally the MEMS fabrication process would be highly desirable. This 'tuning' may improve, for example, the toughness, wear-resistance, fatigue-resistance and/or the surface energy characteristics of the ink ejection face. As a trivial example, when printing hydrophobic liquids such as polymers, the ink ejection face should preferably be relatively hydrophilic rather than hydrophobic (in contrast with printing aqueous inks).

The availability of silicone polymers incorporating nanoparticles (sometimes known in the art as "fillers") means that the characteristics of the silicone polymer (e.g. PDMS, MSQ, PSQ) may be modified by changing the nanoparticles incorporated therein. The use of different nanoparticles will correspondingly 'tune' the characteristics of the ink ejection face defined by the polymer layer 80.

Of course, the nanoparticles may be of any suitable type, size and shape depending on the particular application. The nanoparticles may comprise inorganic particles, organic particles or a combination of both. Some examples of inorganic nanoparticles are metal oxides, metal carbonates and metal sulfates. More specifically, the inorganic nanoparticles may be, for example, silica (including colloidal silica), zirconium oxide, titanium oxide, aluminium oxide, calcium carbonate, tin oxide, zinc oxide, copper oxide, chromium oxide, calcium oxide, tungsten oxide, iron oxide, cobalt oxide, barium sulfate etc. Some examples of organic nanoparticles are cross-linked silicone resin particles (e.g. PDMS, MSQ, PSQ), cross-linked polyolefin resin particles (e.g. polystyrene, polyethylene, polypropylene), cross-linked acryl resin particles, cross-linked styrene-acryl resin particles, cross-linked polyester particles, polyimide particles, melamine resin particles, carbon nanotubes etc.

As used herein, the term "nanoparticles" refers to particles have an average particle size in the range of 1 to 1000 nm, more usually 1 to 100 nm, and more usually 1 to 50 nm. Average particles sizes of about 20 nm are generally preferred. The particles may be monodisperse or polydisperse.

The nanoparticles may be present in an amount ranging from 1 to 70 wt. %, optionally 5 to 60 wt. %, optionally 10 to 50 wt. %. The amount of nanoparticles present will depend on the requisite characteristics of the polymer film.

The nanoparticles may be incorporated into the polymer by any suitable process, such as the sol-gel process, which is well known to the person skilled in the art. The resulting polymer may be deposited by any suitable process, such as a spin-on process followed by hardbaking.

PDMS polymers incorporating silica nanoparticles are known in the art and such polymers may be used as the polymer layer 80 in the present invention. The silica nanoparticles impart the desirable characteristics of wear-resistance and fatigue-resistance to the PDMS polymer. Depending on the amount of silica particles present, the PDMS may also have a relatively hydrophilic surface which is useful in some applications.

It will be appreciated by ordinary workers in this field that numerous variations and/or modifications may be made to the present invention as shown in the specific embodiments without departing from the spirit or scope of the invention as broadly described. The present embodiments are, therefore, to be considered in all respects to be illustrative and not restrictive.

The invention claimed is:

1. A printhead having an ink ejection face, wherein at least part of the ink ejection face is coated with a polymeric material, said polymeric material incorporating nanoparticles, wherein the printhead comprises a plurality of nozzle assemblies formed on a substrate, each nozzle assembly comprising:

a nozzle chamber, a nozzle opening defined in a roof of the nozzle chamber and a thermal bend actuator for ejecting ink through the nozzle opening, said thermal bend actuator comprising:

a first active element for connection to drive circuitry; and a second passive element mechanically cooperating with the first element, such that when a current is passed through the first element, the first element expands relative to the second element, resulting in bending of the actuator, wherein said thermal bend actuator defines at least part of a roof of each nozzle chamber, whereby actuation of said thermal bend actuator moves a moving portion of said roof towards a floor of said nozzle chamber.

2. The printhead of claim 1, wherein the polymeric material is a polymerized siloxane selected from the group consisting of: poly(alkylsilsesquioxanes), poly(arylsilsesquioxanes) and polydialkylsiloxanes.

3. The printhead of claim 2, wherein the polymerized siloxane is selected from the group consisting of: poly(methylsilsesquioxane), poly(phenylsilsesquioxane) and polydimethylsiloxane.

4. The printhead of claim 1, wherein said nanoparticles are selected from the group consisting of: inorganic nanoparticles and organic nanoparticles.

5. The printhead of claim 4, wherein said inorganic nanoparticles are selected from the group consisting of: metal oxides, metal carbonates and metal sulfates.

6. The printhead of claim 4, wherein said inorganic nanoparticles are selected from the group consisting of: silica, zirconium oxide, titanium oxide, aluminium oxide, calcium carbonate, tin oxide, zinc oxide, copper oxide, chromium oxide, calcium oxide, tungsten oxide, iron oxide, cobalt oxide and barium sulfate.

7. The printhead of claim 4 wherein said organic nanoparticles are selected from the group consisting of: cross-linked silicone resin particles, cross-linked polyolefin resin particles, cross-linked acryl resin particles, cross-linked styrene-acryl resin particles, cross-linked polyester particles, polyimide particles, melamine resin particles and carbon nanotubes.

8. The printhead of claim 1, wherein said nanoparticles are incorporated in said polymerized siloxane in an amount ranging from 1 to 70 wt. %.

9. The printhead of claim 1, wherein said nanoparticles have an average particle size in the range of 1 to 100 nm.

10. The printhead of claim 1, wherein the polymeric material is coated on a nozzle plate of the printhead, said nozzle plate being at least partially defined by the roof of each nozzle chamber.

11. The printhead of claim 10, wherein said roof is comprised of a ceramic material selected from the group consisting of: silicon nitride, silicon oxide and silicon oxynitride.

12. The printhead of claim 10, wherein said roof is spaced apart from the substrate, such that sidewalls of each nozzle chamber extend between said nozzle plate and said substrate.

13. The printhead of claim 1, wherein said nozzle opening is defined in either one of: said moving portion of said root or a stationary portion of said roof.

14. The printhead of claim 1, wherein said polymeric material defines a mechanical seal between said moving portion and a stationary portion of said roof, thereby minimizing ink leakage during actuation of said actuator.

* * * * *